US008714866B2

(12) United States Patent
Albritton

(10) Patent No.: US 8,714,866 B2
(45) Date of Patent: May 6, 2014

(54) ENERGY ATTENUATING SAFETY SYSTEM

(71) Applicant: James R. Albritton, Fort Worth, TX (US)

(72) Inventor: James R. Albritton, Fort Worth, TX (US)

(73) Assignee: Trinity Industries, Inc., Dallas, TX (US)

( * ) Notice: Subject to any disclaimer, the term of this patent is extended or adjusted under 35 U.S.C. 154(b) by 0 days.

(21) Appl. No.: 13/856,821

(22) Filed: Apr. 4, 2013

(65) Prior Publication Data

US 2013/0228731 A1 Sep. 5, 2013

Related U.S. Application Data

(60) Continuation of application No. 12/984,207, filed on Jan. 4, 2011, now Pat. No. 8,414,216, which is a division of application No. 11/928,139, filed on Oct. 30, 2007, now Pat. No. 7,871,220, which is a division of application No. 11/008,448, filed on Dec. 9, 2004, now Pat. No. 7,306,397, which is a continuation-in-part of application No. 10/379,748, filed on Mar. 5, 2003, now Pat. No. 7,101,111, which is a continuation-in-part of application No. 09/832,162, filed on Apr. 9, 2001, now Pat. No. 6,536,985, which is a division of application No. 09/356,060, filed on Jul. 19, 1999, now Pat. No. 6,293,727.

(60) Provisional application No. 60/528,092, filed on Dec. 9, 2003, provisional application No. 60/397,529, filed on Jul. 22, 2002.

(51) Int. Cl.
*E01F 15/14* (2006.01)

(52) U.S. Cl.
USPC ..... 404/6; 404/10

(58) Field of Classification Search
USPC ..... 188/371, 375; 404/6, 10; 256/13.1
See application file for complete search history.

(56) References Cited

U.S. PATENT DOCUMENTS

| | | | |
|---|---|---|---|
| 3,674,115 | A | 7/1972 | Young et al. |
| 4,295,637 | A | 10/1981 | Hulek |
| 4,321,989 | A | 3/1982 | Meinzer |
| 4,399,980 | A | 8/1983 | van Schie |

(Continued)

FOREIGN PATENT DOCUMENTS

| | | |
|---|---|---|
| CA | 1292905 | 11/1988 |
| CA | 2465431 A1 | 5/2000 |

(Continued)

OTHER PUBLICATIONS

Chinese Office Action, w/English translation; Application No. 201010624221.8, Dec. 4, 2012.

(Continued)

*Primary Examiner* — Gary Hartmann
(74) *Attorney, Agent, or Firm* — Baker Botts L.L.P.

(57) ABSTRACT

An energy absorbing system with one or more energy absorbing assemblies is provided to reduce or eliminate severity of a collision between a moving vehicle and a roadside hazard. The energy absorbing system may be installed adjacent various roadside hazards or may be installed on highway service equipment. One end of the system may face oncoming traffic. A collision by a motor vehicle with a sled assembly may result in shredding or rupturing of portions of an energy absorbing element to dissipate energy from the vehicle collision.

12 Claims, 11 Drawing Sheets

(56) References Cited

U.S. PATENT DOCUMENTS

| | | | | |
|---|---|---|---|---|
| 4,407,484 | A | 10/1983 | Meinzer | |
| 4,452,431 | A | 6/1984 | Stephens et al. | |
| 4,583,716 | A | 4/1986 | Stephens et al. | |
| 4,815,565 | A | 3/1989 | Sicking et al. | |
| 5,314,261 | A | 5/1994 | Stephens | |
| 5,733,062 | A | 3/1998 | Oberth et al. | |
| 5,797,592 | A | 8/1998 | Machado | |
| 5,851,005 | A | 12/1998 | Muller et al. | |
| 5,868,521 | A | 2/1999 | Oberth et al. | |
| 6,293,727 | B1 | 9/2001 | Albritton | |
| 6,536,985 | B2 | 3/2003 | Albritton | |
| 6,536,986 | B1 | 3/2003 | Anghileri et al. | |
| 6,715,735 | B2 | 4/2004 | Bligh et al. | |
| 6,854,716 | B2 | 2/2005 | Bronstad | |
| 6,905,281 | B2 * | 6/2005 | Kang | 404/6 |
| 6,962,245 | B2 | 11/2005 | Ray et al. | |
| 6,965,511 | B2 | 11/2005 | Rudd et al. | |
| 7,018,130 | B2 | 3/2006 | Smith et al. | |
| 7,070,031 | B2 | 7/2006 | Smith et al. | |
| 7,086,805 | B2 | 8/2006 | Smith et al. | |
| 7,101,111 | B2 | 9/2006 | Albritton | |
| 7,168,880 | B2 * | 1/2007 | Kennedy et al. | 404/6 |
| 7,210,874 | B2 | 5/2007 | Albritton | |
| 7,300,223 | B1 * | 11/2007 | Kennedy et al. | 404/6 |
| 7,306,397 | B2 | 12/2007 | Albritton | |
| 7,597,501 | B2 | 10/2009 | Alberson et al. | |
| 7,871,220 | B2 | 1/2011 | Albritton | |
| 8,215,864 | B2 * | 7/2012 | Kennedy et al. | 404/6 |
| 8,282,082 | B2 * | 10/2012 | An | 256/13.1 |
| 8,414,216 | B2 * | 4/2013 | Albritton | 404/6 |
| 8,434,965 | B2 * | 5/2013 | Chae | 404/6 |
| 2001/0014254 | A1 | 8/2001 | Albritton | |
| 2002/0090260 | A9 | 7/2002 | Albritton | |
| 2003/0175076 | A1 | 9/2003 | Albritton | |
| 2003/0210954 | A1 * | 11/2003 | Kang | 404/6 |
| 2005/0191125 | A1 | 9/2005 | Albritton | |
| 2005/0254893 | A1 | 11/2005 | Albritton | |
| 2006/0193688 | A1 | 8/2006 | Albritton | |
| 2007/0183846 | A1 | 8/2007 | Albritton | |
| 2008/0050174 | A1 | 2/2008 | Albritton | |

FOREIGN PATENT DOCUMENTS

| | | |
|---|---|---|
| EP | 1706544 | 2/2010 |
| FR | 2735164 A1 | 6/1995 |
| WO | 0229162 A1 | 4/2002 |

OTHER PUBLICATIONS

Chinese Office Action, w/English translation; Application No. 201010624221.8, Dec. 31, 2011.

Taiwanese Office Action, w/English translation; Application No. 093138149, Aug. 13, 2012.

Singaporean Search Report and Written Opinion; Singaporean Application No. 200900153-8, Mar. 23, 2011.

Second Office Action issued by the State Intellectual Property Office of the People's Republic of China, Application No. 20040036741.X: Serial No. 2010061000378970, Jun. 13, 2010.

Australian Office Action; Application No. 2004313930, Sep. 15, 2009.

Chinese Office Action; Application No. 03187677.7, Mar. 13, 2009.

Mexican Office Action; Application No. 2006/006590, Apr. 17, 2009.

Mexican Office Action; Application No. 2006/000902, Mar. 9, 2009.

Chilean Office Action; Application No. 3136-04, Jan. 24, 2008.

Application No. 04813624.6-1255, Communication pursuant to Article 94(3) EPC, Jun. 9, 2008.

Israeli Office Action; Application No. 166419, Sep. 28, 2008.

New Zealand Office Action; Application No. 547307, Nov. 27, 2008.

Chilean Office Action, Application No. 31362004, Sep. 12, 2004.

Memoria Descriptiva, 1999.

Extender European Search Report; Application No. 10152311.6-1604; pp. 6, Sep. 12, 2013.

* cited by examiner

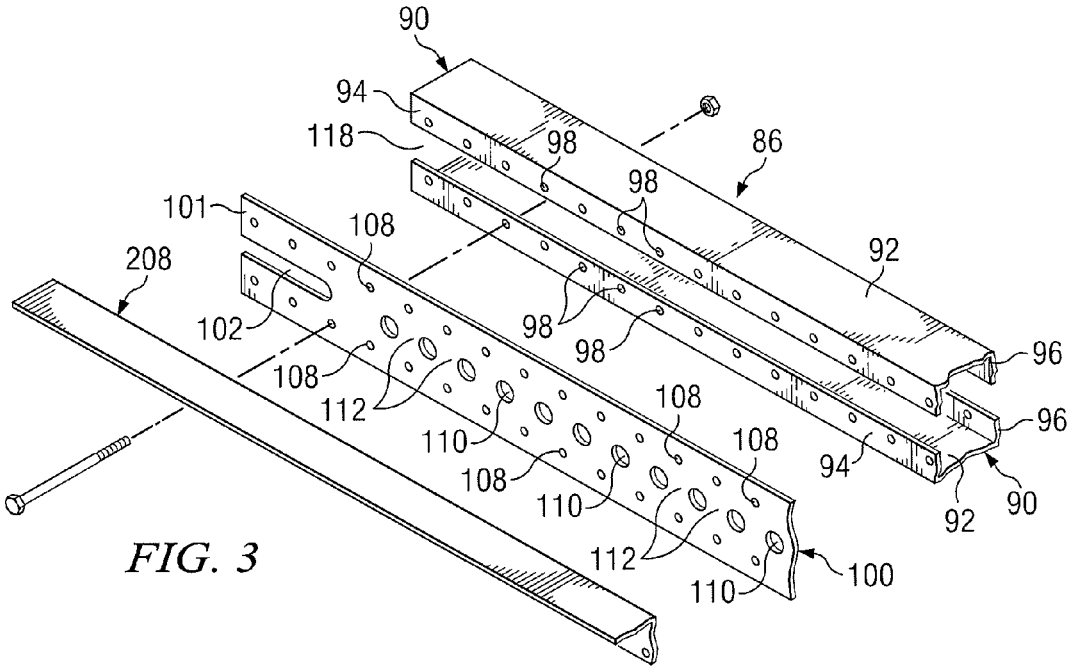
FIG. 3
FIG. 4A
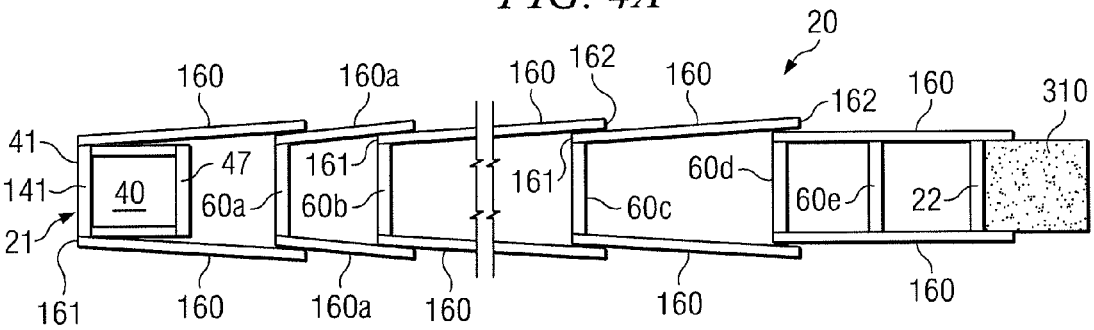
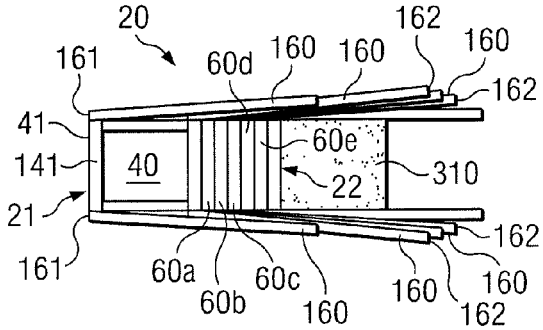
FIG. 4B

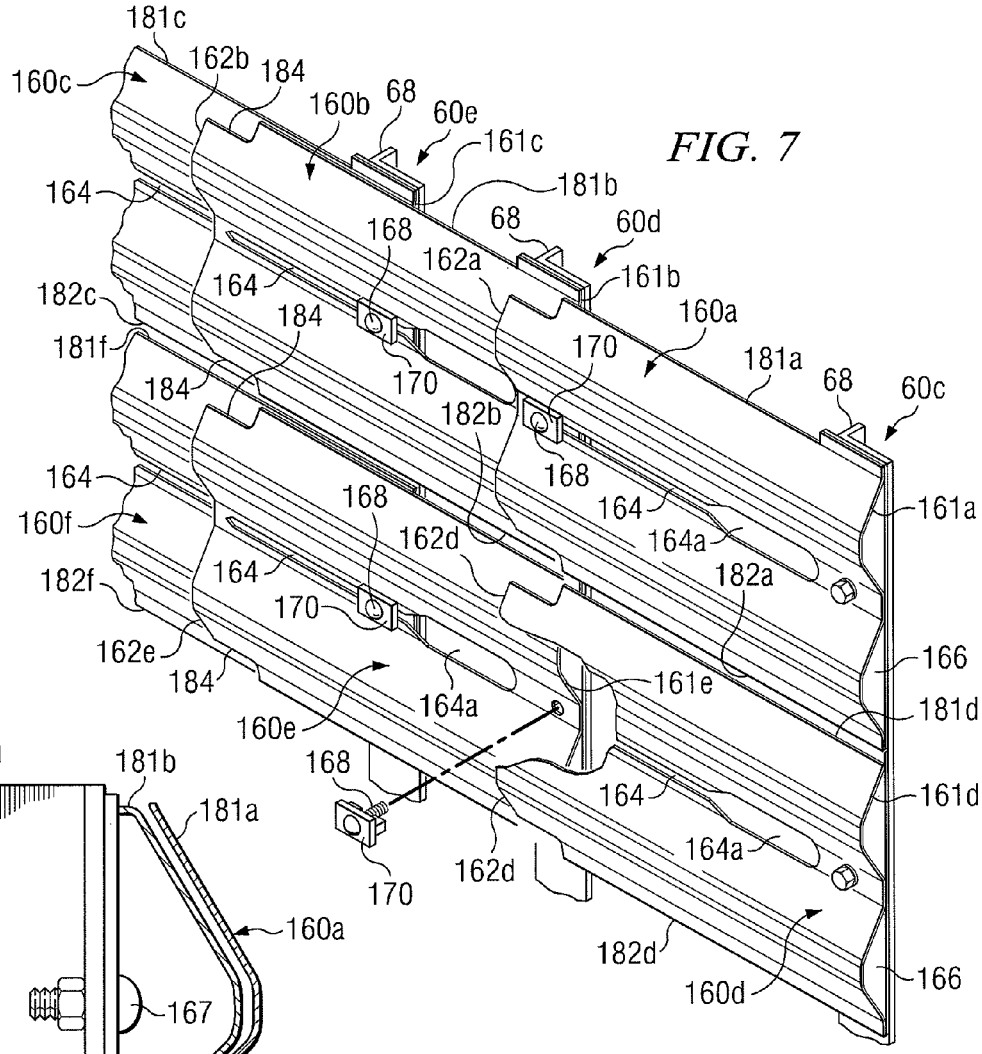
FIG. 7
FIG. 9
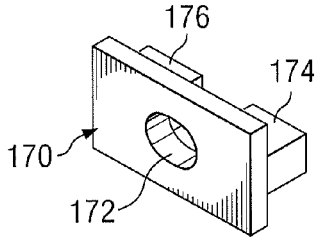

ENERGY ATTENUATING SAFETY SYSTEM

RELATED APPLICATIONS

This patent application is a divisional of U.S. application Ser. No. 11/928,139 filed Oct. 30, 2007 entitled Energy Attenuating Safety System, which is a divisional of U.S. application Ser. No. 11/008,448 filed Dec. 9, 2004 entitled Flared Energy Absorbing System and Method, which claims the benefit of U.S. provisional application Ser. No. 60/528,092 entitled Energy Attenuating Safety System, filed Dec. 9, 2003, and which is a continuation-in-part of U.S. application Ser. No. 10/379,748, filed Mar. 5, 2003 entitled Flared Energy Absorbing System and Method, now U.S. Pat. No. 7,101,111, which claims the benefit of U.S. provisional application Ser. No. 60/397,529 entitled Flared Energy Absorbing System and Method, filed Jul. 22, 2002, and which is a continuation-in-part of application Ser. No. 09/832,162, filed Apr. 9, 2001 entitled Energy Absorbing System for Fixed Roadside Hazards, now U.S. Pat. No. 6,536,985 which is a divisional of U.S. application Ser. No. 09/356,060, filed Jul. 19, 1999 entitled Energy Absorbing System for Fixed Roadside Hazards, now U.S. Pat. No. 6,293,727.

TECHNICAL FIELD OF THE INVENTION

This invention relates in general to energy absorbing systems, and more particularly to an energy absorbing system used to reduce severity of a collision between a moving motor vehicle and a hazard by shredding or rupturing portions of an energy absorbing element.

BACKGROUND OF THE INVENTION

Various impact attenuation devices and energy absorbing systems have been used to prevent or reduce damage resulting from a collision between a moving motor vehicle and various hazards or obstacles. Prior impact attenuation devices and energy absorbing systems such as crash cushions or crash barriers include various types of energy absorbing elements. Some crash barriers rely on inertia forces to absorb energy when material such as sand is accelerated during an impact. Other crash barriers include crushable elements.

Some of these devices and systems have been developed for use at narrow roadside hazards or obstacles such as at the end of a median barrier, end of a barrier extending along the edge of a roadway, large sign posts adjacent to a roadway, and bridge pillars or center piers. Such impact attenuation devices and energy absorbing systems are installed in an effort to minimize the extent of personal injury as well as damage to an impacting vehicle and any structure or equipment associated with the roadside hazard.

Examples of general purpose impact attenuation devices are shown in U.S. Pat. No. 5,011,326 entitled Narrow Stationary Impact Attenuation System; U.S. Pat. No. 4,352,484 entitled Shear Action and Compression Energy Absorber; U.S. Pat. No. 4,645,375 entitled Stationary Impact Attenuation System; and U.S. Pat. No. 3,944,187 entitled Roadway Impact Attenuator. Examples of specialized energy absorbing systems are shown in U.S. Pat. No. 4,928,928 entitled Guardrail Extruder Terminal and U.S. Pat. No. 5,078,366 entitled Guardrail Extruder Terminal. Examples of energy absorbing systems satisfactory for use with highway guardrail systems are shown in U.S. Pat. No. 4,655,434 entitled Energy Absorbing Guardrail Terminal and U.S. Pat. No. 5,957,435 entitled Energy-Absorbing Guardrail End Terminal and Method.

Examples of impact attenuation devices and energy absorbing systems appropriate for use on a slow moving or stopped highway service vehicle are shown in U.S. Pat. No. 5,248,129 entitled Energy Absorbing Roadside Crash Barrier; U.S. Pat. No. 5,199,755 entitled Vehicle Impact Attenuating Device; U.S. Pat. No. 4,711,481 entitled Vehicle Impact Attenuating Device; U.S. Pat. No. 4,008,915 entitled Impact Barrier for Vehicles.

Other examples of impact attenuation devices and energy absorbing systems are shown in U.S. Pat. No. 5,947,452, entitled Energy Absorbing Crash Cushion; U.S. Pat. No. 6,293,727, entitled Energy Absorbing Systems for Fixed Roadside Hazards TRACC; and U.S. Pat. No. 6,536,985, entitled Energy Absorbing System for Fixed Roadside Hazards. The foregoing patents are, hereby incorporated by reference into this application.

Recommended procedures for evaluating performance of various types of highway safety devices including crash cushions is presented in National Cooperative Highway Research Program (NCHRP) Report 350. A crash cushion is generally defined as a device designed to safely stop an impacting vehicle within a relatively short distance. NCHRP Report 350 further classifies crash cushions as either "redirective" or "nonredirective". A redirective crash cushion is designed to contain and redirect a vehicle impacting downstream from a nose or end of the crash cushion facing oncoming traffic extending from a roadside hazard. Nonredirective crash cushions are designed to contain and capture a vehicle impacting downstream from the nose of the crash cushion.

Redirective crash cushions are further classified as either "gating" or "nongating" devices. A gating crash cushion is one designed to allow controlled penetration of a vehicle during impact between the nose of the crash cushion and the beginning of length of need (LON) of the crash cushion. A nongating crash cushion may be designed to have redirection capabilities along its entire length.

SUMMARY OF THE INVENTION

In accordance with teachings of the present invention, disadvantages and limitations associated with previous energy absorbing systems and impact attenuation devices have been substantially reduced or eliminated. One aspect of the present invention includes an energy absorbing system which may be installed adjacent to roadside hazards or hazards located on a roadway to protect occupants of a vehicle during collision with such hazards. The system may include at least one energy absorbing assembly which dissipates energy from a vehicle impacting one end of the system opposite from a hazard. When a vehicle collides with one end of the energy absorbing system, portions of at least one energy absorbing element may be shredded or ruptured to dissipate kinetic energy from the vehicle and provide deceleration within acceptable limits to minimize injury to occupants of the vehicle. Each energy absorbing element may be disposed generally normal to an associated shredder. For some applications each shredder may be disposed generally horizontal relative to associated energy absorbing elements. For other applications each shredder may be disposed generally vertical relative to associated energy absorbing elements.

Technical advantages of the present invention include providing a relatively compact, modular energy absorbing system satisfactory for protecting vehicles during impact with a wide variety of hazards. Energy absorbing systems incorporating teachings of the present invention may be fabricated at relatively low cost using conventional materials and processes which are well known to the highway safety industry.

The resulting systems combine innovative structural designs with energy absorbing techniques that are highly predictable and reliable. Such systems may be easily repaired at relative low cost after a vehicle impact.

Failure mechanisms associated with moving a shredder oriented generally perpendicular through a solid plate may include a series of small thumbnail size chunks being knocked out or shredded or ruptured from the solid plate in front of the shredder as the shredder proceeds longitudinally through the solid plate. For other applications, a shredder oriented generally perpendicular with a solid plate may produce a single line of failure ahead of the shredder as the shredder moves longitudinally through the solid plate. The ruptured material may deflect one way or the other around the shredder. Cooperation between shredders and energy absorbing elements having openings and lands incorporating teachings of the present invention results in a generally consistent, reliable mode of failure which restarts each time shredder moves from one opening through an associated land to another opening.

In accordance with another aspect of the present invention, a crash cushion may be provided with a shredder and one or more energy absorbing elements to optimize performance and repeatability of the crash cushion by shredding or rupturing portions of at least one energy absorbing element. Each energy absorbing element may have alternating lands and openings which cooperate with each other to provide safe, repeatable deceleration of a vehicle impacting one end of the crash cushion. The crash cushion may include a first, relatively soft portion to absorb impact from small, lightweight vehicles and/or slow moving vehicles. The crash cushion may have a middle portion with one or more energy absorbing elements and associated openings and lands. The size of the openings and/or lands may be varied along the length of each energy absorbing element to provide optimum deceleration of an impacting vehicle. The crash cushion may have a third or final portion with one or more energy absorbing elements and associated openings and lands designed to absorb impact from heavy, high speed vehicles in accordance with teachings of the present invention. The present invention may allow reducing the number or length of energy absorbing elements required to dissipate energy from an impacting vehicle by varying the size of openings, spacing of lands or segments between the openings and/or the thickness of each energy absorbing element. For some applications, an energy absorbing assembly may be formed with two or more energy absorbing elements stacked relative to each other.

Further technical advantages of the present invention may include providing relatively low cost crash cushions and other types of safety systems which meet the criteria of NCHRP Report 350 including Test Level 3 Requirements. A safety system having an energy absorbing assembly incorporating teachings of the present invention may be satisfactorily used during harsh weather conditions and is not sensitive to cold or moisture. The system may be easily installed, operated, inspected and maintained. The system may be installed on new or existing asphalt or concrete pads. A modular safety system incorporating teachings of the present invention may eliminate or substantially reduce field assembly of impact attenuation devices and energy absorbing components. Easily replaceable parts allow quick, low cost repair after nuisance hits and side impacts. Elimination of easily crushed or easily bent materials further minimizes the effect of any damage from nuisance hits and/or side impacts with the system.

Technical benefits of the present invention may include a modular energy absorbing system that may be used with permanent roadside hazards or may be easily moved from one temporary location (first work zone) to another temporary location (second work zone). A safety system incorporating teachings of the present invention may also be mounted on trucks and other types of highway service equipment.

Technical benefits of the present invention may also include installing one or more energy absorbing assemblies with respective energy absorbing elements disposed in substantially horizontal positions. As a result, the energy absorbing elements may be more easily replaced and/or repaired after a vehicle impact with an associated crash cushion or other energy absorbing system.

An energy absorbing system incorporating teachings of the present invention may have energy absorbing assemblies arranged in various configurations. For some applications, only a single row of energy absorbing assemblies may be installed adjacent to a hazard. For other applications, three or more rows of energy absorbing assemblies may be installed. Also, each row may only have one energy absorbing assembly or multiple energy absorbing assemblies. The present invention allows modifying an energy absorbing system to minimize possible injury to both restrained and unrestrained occupants in a wide variety of vehicles traveling at various speeds.

An energy absorbing system incorporating teachings of the present invention may more easily be repaired following impact by a vehicle. Energy absorbing elements may be disposed in a horizontal position and securely attached to other components of the energy absorbing system by a relatively small number of mechanical fasteners. For example, one bolt and associated nut may be used to provide the holding power or structural strength of three or four bolts and associated nuts. As a result, the energy absorbing elements may be more quickly and more easily replaced following a vehicle impact. Panels attached along sides of the energy absorbing system may be more quickly and more easily replaced following a vehicle impact. For some applications modules which may be easily replaced are used to shred energy absorbing elements to dissipate energy from a vehicle impact. Each module may include a bolt or other type of blunt shredder that may be easily replaced. The present invention does not include any type of cutter or sharp edge. An energy absorbing system incorporating teachings of the present invention may be installed as a modular unit, removed as a modular unit following a vehicle impact and replaced by a new modular unit.

BRIEF DESCRIPTION OF THE DRAWINGS

A more complete understanding of the present invention may be acquired by referring to the following descriptions taken in conjunction with the accompanying drawings in which like reference numbers indicate like features and wherein:

FIG. 3 is a schematic drawing showing an exploded, isometric view with portions broken of an energy absorbing assembly and an energy absorbing element having lands or segments disposed between respective openings or holes in accordance with teachings of the present invention;

FIG. 4A is a schematic drawing showing a plan view with portions broken away of an energy absorbing system incorporating teachings of the present invention;

FIG. 4B is a schematic drawing showing a plan view with portions broken away after a vehicle has collided with one end of the energy absorbing system of FIG. 4A;

FIG. 7 is a schematic drawing showing an isometric view of overlapping panels disposed along one side of an energy absorbing system incorporating teachings of the present invention;

FIG. 8 is a schematic drawing in section with portions broken away showing a first upstream panel and a second downstream panel slidably disposed relative to each other;

FIG. 9 is a schematic drawing showing an isometric view of a slot plate satisfactory for releasably engaging a panel with a panel support frame in accordance with teachings of the present invention;

DETAILED DESCRIPTION OF THE INVENTION

Figure 1:
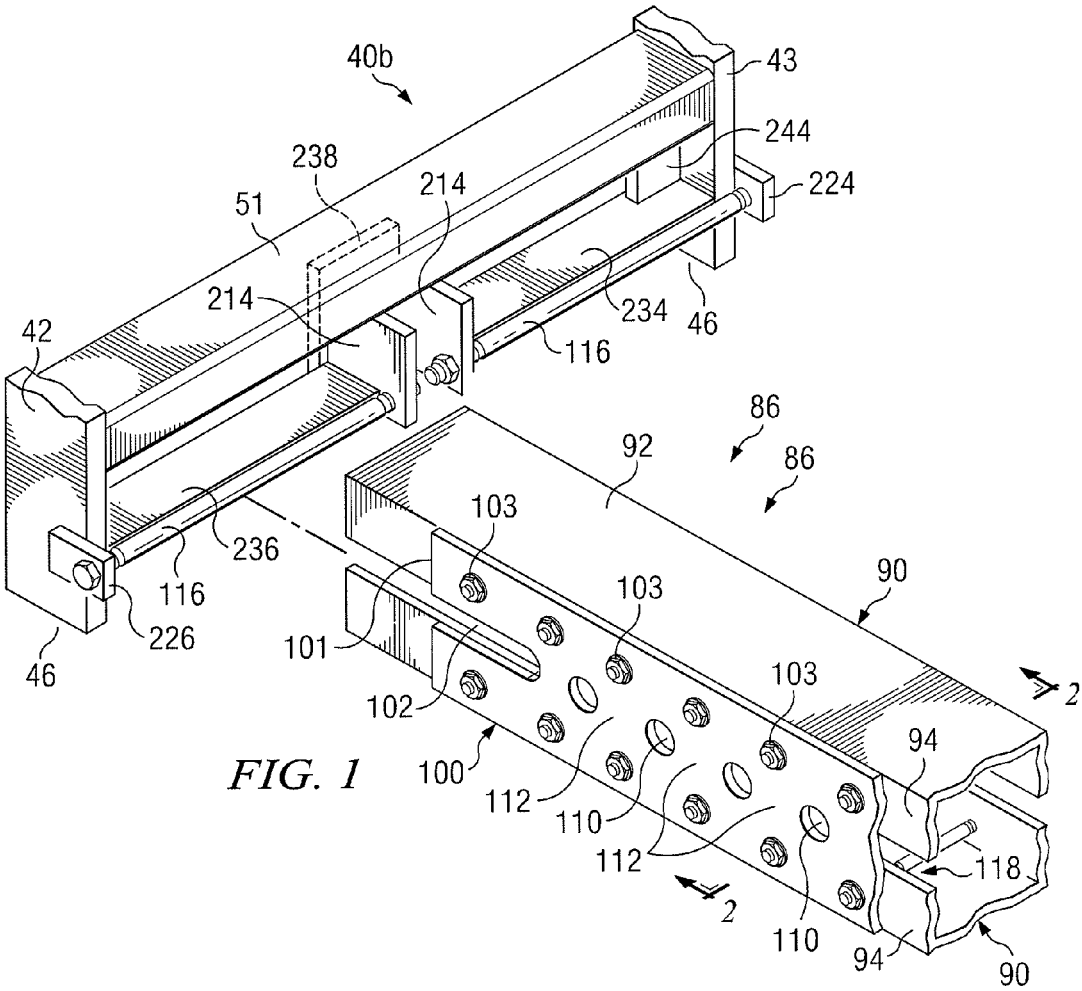
FIG. 1 is a schematic drawing showing an isometric view with portions broken away of a shredder and an energy absorbing assembly incorporating teachings of the present invention.

The present invention and its advantages may be better understood by referring to FIGS. 1-17 of the drawings, like numerals being used for like and corresponding parts of the drawings.

The terms "longitudinal," "longitudinally" and "linear" will generally be used to describe the orientation and/or movement of components associated with an energy absorbing system incorporating teachings of the present invention in a direction substantially parallel to the direction vehicles (not expressly shown) travel on an associated roadway. The terms "lateral" and "laterally" will generally be used to describe the orientation and/or movement of components associated with an energy absorbing system incorporating teachings of the present invention in a direction substantially normal to the direction vehicles travel on an associated roadway. Some components of energy absorbing systems incorporating teachings of the present invention may be disposed at an angle or flare (not expressly shown) relative to the direction vehicles travel on an adjacent roadway.

The term "downstream" will generally be used to describe movement which is approximately parallel with and in approximately the same general direction as movement of a vehicle traveling an associated roadway.

The term "upstream" will generally be used to describe movement which is approximately parallel with but in approximately an opposite direction as movement of a vehicle traveling on an associated roadway. The terms "upstream" and "downstream" may also be used to describe the position of one component relative to another component in an energy absorbing system incorporating teachings of the present invention.

The terms "shred, shredding, rupture and rupturing" may generally be used to describe the results of a shredder engaging portions of an energy absorbing element to dissipate energy of an impacting vehicle in accordance with teachings of the present invention. The terms "shred, shredding, rupture and rupturing" may also be used to describe the combined effects of ripping, tearing and/or breaching portions of an energy absorbing element without cutting portions of the energy absorbing element. U.S. Pat. No. 4,655,434 entitled Energy Absorbing Guardrail Terminal and U.S. Pat. No. 5,957,435 entitled Energy Absorbing Guardrail End Terminal and Method show examples of shredding material disposed between spaced openings to absorb kinetic energy of an impacting vehicle.

The terms "gore" and "gore area" may be used to describe the area where two roadways diverge or converge. A gore is typically bounded on two sides by the edges of the roadways which join at the point of divergence or convergence. Traffic flow is often in the same direction on both of the roadways. A gore area may include shoulders or marked pavement between the roadways. The third side or third boundary of a gore area may sometimes be defined as approximately sixty (60) meters from the point of divergence or convergence of the roadways.

The term "roadside hazard" may be used to describe permanent, fixed roadside hazards such as a large sign post, a bridge pillar or a center pier of a bridge or overpass. Roadside hazards may also include a temporary work area disposed adjacent to a roadway or located between two roadways. A temporary work area may include various types of equipment and/or vehicles associated with road repair or construction. The term "roadside hazard" may also include a gore area or any other structure located adjacent to a roadway and presenting a hazard to oncoming traffic.

The terms "hazard" and "hazards" may be used to describe both roadside hazards and hazards located on a roadway such as slow moving vehicles or equipment and stopped vehicles or equipment. Examples of such hazards may include, but are not limited to, highway safety trucks and equipment performing construction, maintenance and repair of an associated roadway.

Various components of an energy absorbing system incorporating teachings of the present invention may be formed from commercially available structural steel materials. Examples of such materials include steel strips, steel plates, structural steel tubing, structural steel shapes and galvanized steel. Examples of structural steel shapes include W shapes, HP shapes, beams, channels, tees, and angles. Structural steel angles may have legs with equal or unequal width. The American Institute of Steel Construction publishes detailed information concerning various types of commercially available structural steel materials satisfactory for use in fabricating energy absorbing systems incorporating teachings of the present invention.

For some applications, various components of an energy absorbing system incorporating teachings of the present invention may be formed from composite materials, cermets and any other material satisfactory for use with highway safety systems. The present invention is not limited to only forming energy absorbing systems from steel based materials. Any metal alloy, nonmetallic materials and combinations thereof which are satisfactory for use in highway safety systems may be used to form an energy absorbing system incorporating teachings of the present invention. For some applications, energy absorbing elements incorporating teachings of the present invention may be formed from mild steel.

Energy absorbing systems 20, 20*a*, 20*b* and 20*c* incorporating teachings of the present invention may sometimes be referred to as crash cushions, crash barriers, or roadside protective systems. Energy absorbing systems 20, 20*a*, 20*b* and 20*c* may be used to minimize the results of a collision between a motor vehicle (not expressly shown) and various types of hazards. Energy absorbing systems 20, 20*a*, 20*b* and 20*c* and other energy absorbing systems incorporating teachings of the present invention may be used for both permanent installation and temporary work-zone applications. Energy absorbing systems 20, 20*a*, 20*b* and 20*c* may sometimes be described as nongating, redirective crash cushions. Energy absorbing systems 20, 20*a*, 20*b* and 20*c* and other energy absorbing systems incorporating teachings of the present invention may meet or exceed NCHRP Report 350, Test Level 3 requirements.

Figure 4C:
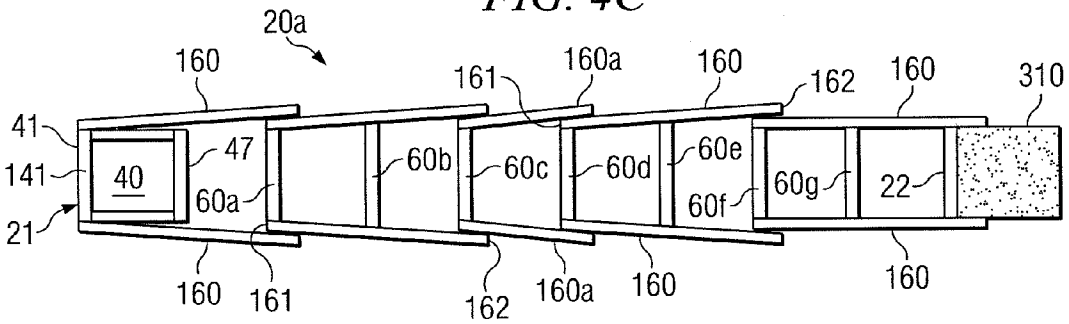
FIG. 4C is a schematic drawing showing a plan view of another energy absorbing system incorporating teachings of the present invention.
Figure 5:
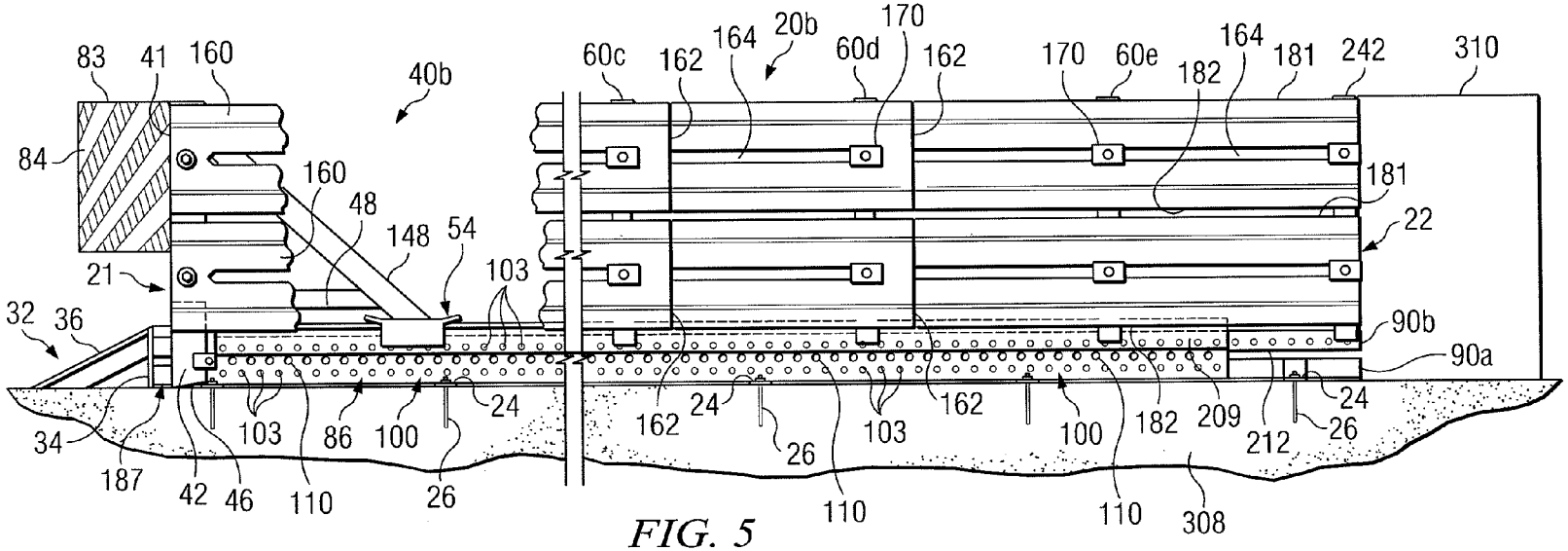
FIG. 5 is a schematic drawing in elevation with portions broken away showing an energy absorbing system incorporating teachings of the present invention.
Figure 6:
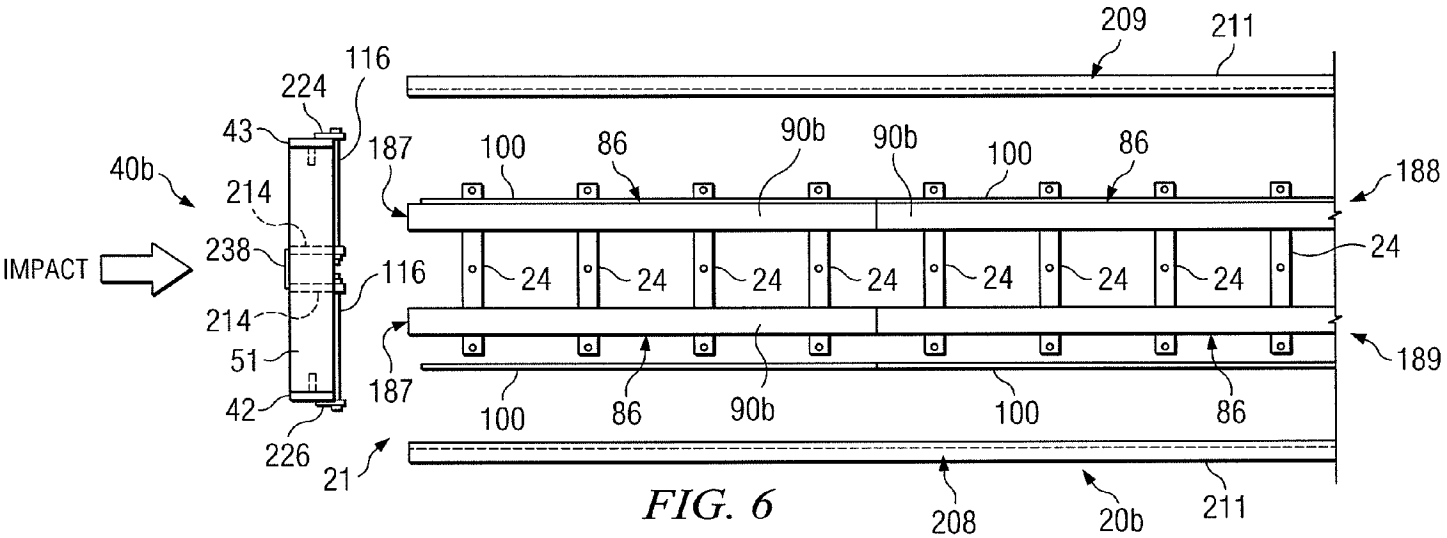
FIG. 6 is a schematic drawing with portions broken away showing an exploded, plan view of the energy absorbing system, associated shredders; energy absorbing assemblies and guide rails as shown in FIG. 5.

Various features of the present invention will be described with respect to energy absorbing system 20 as shown in FIGS. 4A and 4B, energy absorbing system 20*a* as shown in FIG. 4C and energy absorbing system 20*b* as shown in FIGS. 5 and 6 and energy absorbing system 20*c* as shown in FIGS. 10-15. Various types of shredders and energy absorbing assemblies incorporating teachings of the present invention may be used with energy absorbing systems 20, 20*a*, 20*b* and 20*c*. The present invention is not limited to shredders 116 and 216, energy absorbing assemblies 86 and 286 or associated energy absorbing elements 100, 100*a*, 100*b*, 100*c* and 100*d*.

For some applications energy absorbing systems 20, 20*a*, 20*b* and 20*c* may be installed as respective modular units. Also various components and/or subsystems of each energy absorbing system may be installed and removed as separate, individual modules. For example, energy absorbing assemblies may be formed into rows and engaged with respective cross ties and guide rails formed in accordance with teachings of the present invention. The resulting base module may then be installed adjacent to a hazard. Panel support frames and panels may also be manufactured and assembled as a module or series of modules which are delivered to a work site for installation on the associated base module. Sled assemblies 40, 40*a*, 40*b* and 40*c* may also be assembled and delivered to a work site as a single module. Threaders formed in accordance with teachings of the present invention may also be installed as replaceable modules.

Energy absorbing systems 20 and 20*a* may include sled assembly 40. Energy absorbing system 20*b* may include sled assembly 40*b*. Energy absorbing system 20*c* may include sled assembly 40*c*. First end 41 of each sled assembly 40, 40*b* and 40*c* may correspond generally with first end 21 of associated energy absorbing systems 20, 20*a* and 20*b* and 20*c*. Materials used to form sled assemblies 40, 40*b* and 40*c* are preferably selected to allow sled assemblies 40, 40*b* and 40*c* to remain intact after impact by a high speed vehicle.

The dimensions and configuration of first end 41 of sled assemblies 40, 40*b* and 40*c*, defined in part by corner posts 42 and 43, top brace 141 and bottom brace 51, may be selected to catch or gather an impacting vehicle. During a collision between a motor vehicle and first end 21 of energy absorbing systems 20, 20*a*, 20*b* or 20*c*, kinetic energy from the colliding vehicle may be transferred from first end 41 to other components of associated sled assembly 40, 40*b* or 40*c*. The dimensions and configuration of end 41 may also be selected to effectively transfer kinetic energy even if a vehicle does not impact the center of first end 41 or if a vehicle impacts end 41 at an angle other than parallel with the longitudinal axis of associated energy absorbing system 20, 20*a*, 20*b* and 20*c*.

Respective panels 160 may be attached to the sides of each sled assembly 40, 40*b* and 40*c* extending from respective first end 41. For purposes of describing various features of the present invention, panels 160 are shown broken away from the sides of sled assembly 40*b* in FIG. 5. Panels 160 have been removed from one side of sled assembly 40*c* in FIGS. 10 and 11.

Roadside hazard 310 shown in FIGS. 4A, 4C, and 5 may be a concrete barrier extending along the edge or side of a roadway (not expressly shown). Roadside hazard 310 may also be a concrete barrier extending along the median between two roadways. Roadside hazard 310 may be a permanent installation or a temporary installation associated with a work area. Roadside hazard 310 may sometimes be described as a "fixed" barrier or "fixed" obstacle even though concrete barriers and other obstacles adjacent to a roadway or disposed in a roadway may from time to time be moved or removed. An energy absorbing system incorporating teachings of the present invention is not limited to use with only concrete barriers. Energy absorbing systems incorporating teachings of the present invention may be installed adjacent to various types of hazards facing oncoming traffic.

Figure 2:
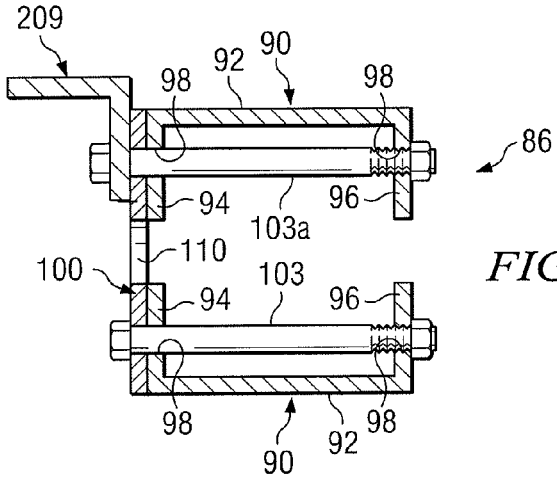
FIG. 2 is a schematic drawing in section with portions broken away taken along lines 2-2 of FIG. 1.

Examples of shredders and energy absorbing assemblies incorporating teachings of the present invention are shown in FIGS. 1-3. Energy absorbing assembly 86, as shown in FIGS. 1, 2 and 3, may sometimes be referred to as a "box beam." Energy absorbing assembly 86 may include a pair of supporting beams 90 disposed longitudinally parallel with each other and spaced from each other. Each supporting beam 90 may have a generally C-shaped or U-shaped cross section. Supporting beams 90 may sometimes be described as channels.

The C-shaped cross section of each supporting beam 90 may be disposed facing each other to define a generally rectangular cross section for each energy absorbing assembly 86. The C-shaped cross section of each supporting beam 90 may be defined in part by web 92 and flanges 94 and 96 extending therefrom. A plurality of holes 98 may be formed in flanges 94 and 96 to attach one or more energy absorbing elements 100 with energy absorbing assembly 86. For one application, supporting beams or channels 90 may have an overall length of approximately eleven feet with a web width of approximately five inches and a flange height of approximately two inches. A wide variety of fasteners may be inserted through holes 98 in supporting beams 90 and corresponding holes 108 formed in energy absorbing element 100 to satisfactorily attach energy absorbing elements 100 with supporting beams 90.

For embodiments shown in FIGS. 1, 2 and 3, fasteners 103 preferably extend through respective holes 108 in energy absorbing element 100 and respective holes 98 in flanges 94 and 96. Fasteners 103 may be selected to allow easy replacement of energy absorbing element 100 after collision of a motor vehicle with one end of an associated energy absorbing system.

One requirement for attaching energy absorbing elements 100 with supporting beams 90 includes providing appropriately sized shredding zone 118 as shown in FIG. 3 between supporting beams 90 to accommodate the associated shredder 116. For some applications, a combination of long bolts and short bolts may be satisfactorily used. For other applications, the mechanical fasteners may be blind threaded rivets and associated nuts. A wide variety of blind rivets, bolts and other fasteners may be satisfactorily used with the present invention. Examples of such fasteners are available from Huck International, Inc., located at 6 Thomas, Irvine, Calif. 92718-2585. Power tools satisfactory for installing such blind rivets are also available from Huck International and other vendors.

For embodiments shown in FIGS. 1, 2, and 3, only one energy absorbing element 100 may be attached to flanges 94 on one side of energy absorbing assembly 86. For some applications, another energy absorbing element 100 may be attached to flanges 96 on the opposite side of energy absorbing assembly 86. For other applications, multiple energy absorbing elements 100 and spacers (not expressly shown) may be attached to one or both flanges 94 and 96.

A row of holes or openings 110 may be formed extending generally along a longitudinal center line of energy absorbing element 100. Openings or holes 110 may also be described as perforations. For some applications, openings 110 may have a generally circular configuration with a diameter of approximately one inch. Openings 110 are preferably spaced from each other with respective lands or segments 112 disposed there between as shown in FIGS. 1, 2 and 3. The spacing between adjacent holes 110, the dimensions of holes 110 and corresponding lands or segments 112 may be varied in accordance with teachings of the present invention to control the amount of force or energy required to move respective shredder 116 therethrough.

Without the presence of openings 110, the force required to move shredder 116 through energy absorbing element 100 may vary depending upon the specific type of failure mechanism. The failure mechanism associated with moving shredder 116 longitudinally through a solid plate may vary along the length of the solid plate. The presence of openings 110 and segments 112 results in improved repeatability and accuracy of energy absorption as shredder 116 moves longitudinally through energy absorbing element 100.

The configuration and dimensions of openings 110 and segments 112 may be substantially varied in accordance with teachings of the present invention to provide desired energy absorbing characteristics for an associated energy absorbing assembly. For example, openings 110 may have a generally circular, oval, slot, rectangular, star or any other suitable geometric configuration.

For some applications, openings 110 and segments 112 may have substantially uniform dimensions along the length of each energy absorbing element 100. For other applications, the dimensions of openings 110 and/or the dimensions of respective segments 112 may be varied to provide for a relatively "soft" deceleration when a vehicle initially impacts an associated energy absorbing assembly followed by increasing deceleration or increasing energy absorption along a middle portion of an associated energy absorbing element 100. The last portion of the associated energy absorbing element 100 may provide reduced deceleration or reduced energy absorption as the speed of an impacting vehicle decreases.

Alternatively, openings 110 in energy absorbing elements 100 need not be discrete, but may be interconnected by slots (not expressly shown). As shredder 116 moves through openings 116 and associated slots, energy absorbing element 100, already divided by the slots interconnecting openings 110, resists the movement of shredder 116. Shredder 116 may bend or otherwise deform the slots in energy absorbing element 100, wherein energy is absorbed and dissipated.

The number of energy absorbing elements 100 and their length and thickness may be varied depending upon the intended application for the resulting energy absorbing assembly. Increasing the number of energy absorbing elements, increasing their thickness and/or increasing length will allow the resulting energy absorbing assembly to dissipate an increased amount of kinetic energy. Benefits of the present invention include the ability to vary the geometric configuration and number of openings 110 and segments 112 and select appropriate materials to form energy absorbing elements 100 depending upon the intended application for the resulting energy absorbing assembly. Energy absorbing elements 100 and other components of an energy absorbing system incorporating teachings of the present invention may be galvanized to insure that they retain their desired tensile strength and are not affected by environmental conditions which may cause rust or corrosion during the life of the associated energy absorbing system.

For some embodiments such as shown in FIGS. 1-3, 5 and 6, each shredder 116 may be disposed adjacent to one end of energy absorbing assembly 86. As discussed later in more detail, a pair of shredders 116 may be attached to sled assembly **40*b* in accordance with teachings of the present invention. For some applications shredders 116 may be disposed generally horizontal relative to sled assembly 40*b* and an associated roadway (not expressly shown). Each energy absorbing element 100 and associated slot 102 may be disposed generally vertical relative to respective shredder 116** and the associated roadway.

The dimensions associated with each shredder 116 are preferably compatible with slot 102 formed in the end of each energy absorbing element 100 adjacent to respective shredder 116 and shredding zone 118 formed between associated supporting beams 90. The dimensions are selected to allow shredder 116 to slide longitudinally between flanges 94 and 96 of adjacent supporting beams 90. For one application, slot 102 at first end 101 may be formed along the centerline of energy absorbing element 100 with a width of approximately three quarters of an inch and a length of approximately six inches.

The diameter of shredder 116 may be smaller than the diameter of openings 110. This need not always be the case however. The diameter of shredder 116 may be the same or even larger than the diameter of openings 110. For some applications shredder 116 may be a bolt having a diameter of approximately one-half of one inch and a length of approximately twelve inches. Specific dimensions of shredder 116 and associated energy absorbing elements 100 may be varied depending upon the amount of kinetic energy which will be dissipated by energy absorbing assembly 86.

Material used to form each shredder 116 will depend upon the material used to form associated energy absorbing elements 100. For some applications, shredder 116 may have a minimum Rockwell hardness of C39. Shredders having various configurations such as cylindrical bars with generally circular cross-sections or bars with generally square or rectangular cross-sections (not expressly shown) may also be satisfactorily used with an energy absorbing assembly incorporating teachings of the present invention.

For some applications, energy absorbing assembly 86 may remain relatively stationary or fixed while an associated shredder 116 moves longitudinally through openings 110 and segments 112 to absorb energy from an impacting vehicle. For other applications (not expressly shown), shredder 116 may remain relatively fixed while an associated energy absorbing assembly 86 including openings 110 and segments 112 moves longitudinally with respect to shredder 116 to absorb energy from an impacting vehicle.

Energy absorbing element 100 may provide deceleration characteristics tailored for specific vehicle weights and speeds. For example, during approximately the first few feet of travel of shredder 116 through associated energy absorbing assembly 86, two stages of stopping force or deceleration appropriate for a vehicle weighing approximately 820 kilograms may be provided. The remaining travel of shredder 116 through associated energy absorbing assembly 86 may provide stopping force appropriate for larger vehicles weighing approximately 2,000 kilograms. Variations in the location, size, configuration and number of energy absorbing elements 100 allows energy absorbing assembly to provide safe deceleration of vehicles weighing between 820 kilograms and 2,000 kilograms.

FIG. 4A shows energy absorbing system 20 in its first position, extending longitudinally from roadside hazard 310. Sled assembly 40, slidably disposed at first end 21 of energy absorbing system 20, may sometimes be referred to as an "impact sled." Slots 102 may be used to receive respective shredders 116 during installation and alignment of sled assembly 40 with energy absorbing elements 100. First end 21 of energy absorbing system 20 including first end 41 of sled assembly 40 preferably face oncoming traffic. Second end 22 of energy absorbing system 20 may be securely attached to the end of roadside hazard 310 facing oncoming traffic. Energy absorbing system 20 is typically installed in its first position with first end 21 longitudinally spaced from second end 22 as shown in FIG. 4A.

Figure 16:
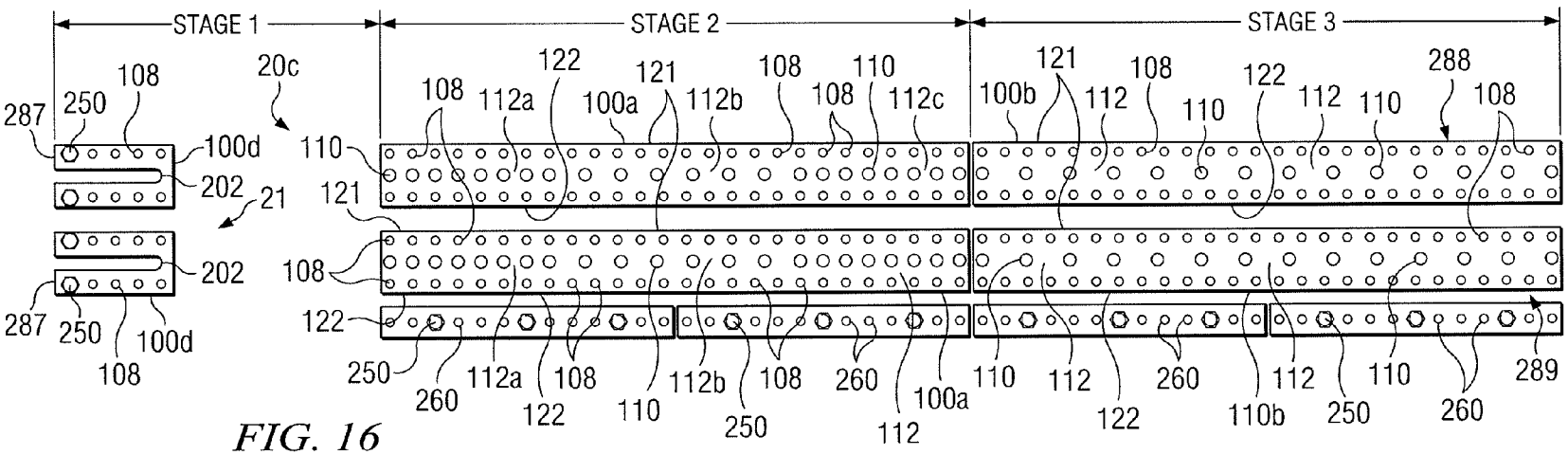
FIG. 16 is a schematic drawing with portions broken away showing a plan view of energy absorbing elements incorporating teachings of the present invention.

A plurality of panel support frames 60*a*-60*e* may be spaced longitudinally from each other and slidably disposed between first end 21 and second end 22. Panel support frames 60*a*-60*e* may sometimes be referred to as "frame assemblies." The number of panel support frames may be varied depending upon the desired length of an associated energy absorbing system. Multiple panels 160 may be attached to sled assembly 40 and panel support frames 60*a*-60*e*. Panels 160 may sometimes be referred to as "fenders" or "fender panels." One example of a panel support frame satisfactory for use with energy absorbing systems 20 20*a*, 20*b* and 20*c* is shown in FIG. 16.

When a vehicle impacts with first end 21 of energy absorbing system 20, sled assembly 40 will move generally longitudinally toward roadside hazard 310. Energy absorbing assemblies 86 (not expressly shown in FIGS. 4A and 4B) will absorb energy from the impacting vehicle during this movement. Movement of panel support frames 60*a*-60*e* and associated panels 160 relative to each other may also absorb energy from a vehicle impacting first end 21.

FIG. 4B is a schematic drawing showing a plan view of sled assembly 40 and panel support frames 60*a*-60*e* and their associated panels 160 collapsed adjacent to each other. Further longitudinal movement of sled assembly 40 toward roadside hazard 310 is prevented by panel support frames 60*a*-60*e*. The position of energy absorbing system 20 as shown in FIG. 4B may be referred to as the "second" position. During most vehicle collisions with end 21 of energy absorbing system 20, sled assembly 40 will generally move only a portion of the distance between the first position as shown in FIG. 4A and the second position as shown in FIG. 4B.

Panel support frames 60*a*-60*e*, associated panels 160 and other components of energy absorbing system 20 cooperate with each other to redirect vehicles striking either side of energy absorbing system 20 back onto an associated roadway. Respective panels 160 may be attached to sled assembly 40 and preferably extend over a portion of respective panels 160 attached to panel support frame 60*a*. In a corresponding manner, panels 160 attached to panel support frame 60*a* preferably extend over a corresponding portion of panels 160 attached to panel support frame 60*b*. Various components of energy absorbing system 20 provide substantial lateral support to panel support frames 60*a*-60*e* and panels 160.

First end 161 of each panel 160 may be securely attached to sled assembly 40 or respective panel support frames 60*a*-60*d* as appropriate. Each panel 160 may also be slidably attached to one or more downstream panel support frames 60*a*-60*e*. Up stream panels 160 overlap down stream panels 160 to allow telescoping or nesting of respective panels 160 as panel support frames 60*a*-60*e* slide toward each other. Subsets of panel support frames 60*a*-60*e* and panels 160 may be grouped together to form a one-bay group or a two-bay group.

For purposes of illustration, second end 162 of each upstream panel 160 is shown in FIGS. 4A and 4B projecting a substantial distance laterally at the overlap with the associated downstream panel 160. Panels 160 may nest closely with each other to minimize any lateral projection at second end 162 which might snag a vehicle during a reverse angle impact with either side of energy absorbing system 20.

FIG. 4C is a schematic drawing showing a plan view of energy absorbing system 20*a* in its first position, extending longitudinally from roadside hazard 310. Energy absorbing system 20*a* may include first end 21 facing oncoming traffic and second end 22 securely attached to roadside hazard 310. Energy absorbing system 20*a* also includes sled assembly 40, panel support frames 60*a*-60*g* and respective panels 160.

Panels 160 extending along both sides of energy absorbing systems 20 and 20*a* may have substantially the same configuration. However, the length of panels 160 may vary depending on whether the respective panel is a "one-bay panel" or a "two-bay panel." For purposes of explanation, a "bay" is defined as the distance between two adjacent panels support frames 60.

The length of panels 160 designated as "two-bay panels" is selected to span the distance between three-panel support frames when energy absorbing systems 20 and 20*a* are in their first position. For example, first end 161 of a two-bay panel 160 is preferably securely attached to upstream panel support frame 60*a*. Second end 162 of the two-bay panel 160 is preferably slidably attached to downstream panel support frame 60*c*. Another panel support frame 60*b* is slidably coupled with two-bay panels 160 intermediate first end 161 and second end 162.

When sled assembly 40 hits panel support frame 60*a* which may in turn contact panel support frame 60*b* and then 60*c*, etc., the panel support frames 60*a*-60*g* and attached panels 160 are accelerated toward roadside hazard 310. The inertia of panel support frames 60*a*-60*g* and attached panels 160 contributes to deceleration of an impacting vehicle.

If the panel support frame of a one-bay group is hit, the one-bay group will be coupled to its own associated panels 160 and, therefore, will have relatively high inertia. To soften deceleration of an impacting vehicle, a two-bay group is preferably disposed downstream from each one-bay group. When sled assembly 40, or one or more panel support frames being pushed by sled assembly 40, contacts the first panel support frame of a two-bay group (e.g., panel support frame 60*d*), the inertia may be the same or slightly more than (because of the longer panels 160) the inertia of a one-bay group. However, when the second panel support frame of the two-bay group (e.g., panel support frame 60*e*) is contacted, the second panel support frame 60 may have a lower inertia because it is only slidably coupled to the associated panels 160. Therefore, deceleration is somewhat reduced.

Energy absorbing system 20*a* has the following groups of bays: 2-2-1-2-2, where "2" means two bays and "1" means one bay. Beginning at sled assembly 40 and moving toward roadside hazard 310, energy absorbing system 20*a* has a two-bay group (counting sled assembly 40 as a bay in and of itself), another two-bay group, a one-bay group, followed by a two-bay group and another two-bay group.

Energy absorbing system 20*b* as shown in FIGS. 5 and 6 may include sled assembly 40*b* and multiple energy absorbing assemblies 86 aligned in respective rows 188 and 189 extending generally longitudinally from hazard 310 and generally parallel with each other. Sled assembly 40*b* may have a modified configuration as compared with sled assembly 40. For some applications guide rails 208 and 209 may also be attached with energy absorbing assemblies 86. See FIGS. 2 and 3.

Energy absorbing assemblies 86 may be secured to each other by a plurality of cross braces 24. Cooperation between cross braces 24 and energy absorbing assemblies 86 results in energy absorbing system 20*b* having a relatively rigid frame structure. As a result, energy absorbing system 20*b* may be better able to safely absorb impact from a motor vehicle that strikes sled assembly 40*b* either offset from the center of end 21 or that strikes end 21 at an angle other than approximately parallel with energy absorbing assemblies 86.

As shown in FIG. 5, nose cover 83 may be attached to sled assembly 40*b* proximate first end 21 of energy absorbing system 20*b*. Nose cover 83 may be a generally rectangular sheet of flexible plastic type material. Opposite edges of nose cover 83 may be attached to corresponding opposite sides of sled assembly 40*b* at end 41. Nose cover 83 may include a plurality of chevron delineators 84 which are visible to oncoming traffic approaching roadside hazard 310. Various types of nose covers, reflectors and/or warning signs may also be mounted on sled assemblies 40, 40*b* and 40*c* and along each side of energy absorbing systems 20, 20*a*, 20*b* and 20*c*.

For some applications, each row 188 and 189 may contain two or more energy absorbing assemblies 86. Energy absorbing assemblies 86 in row 188 may be spaced laterally from energy absorbing assemblies 86 in row 189. Energy absorbing assemblies 86 may be securely attached to concrete foundation 308 in front of roadside hazard 310. Each row 188 and 189 of energy absorbing assemblies 86 may have respective first end 187 which corresponds generally with first end 21 of energy absorbing system 20*b*. First end 41 of sled assembly 40*b* may also be disposed adjacent to first end 187 of rows 188 and 189 prior to a vehicle impact.

Figure 10:
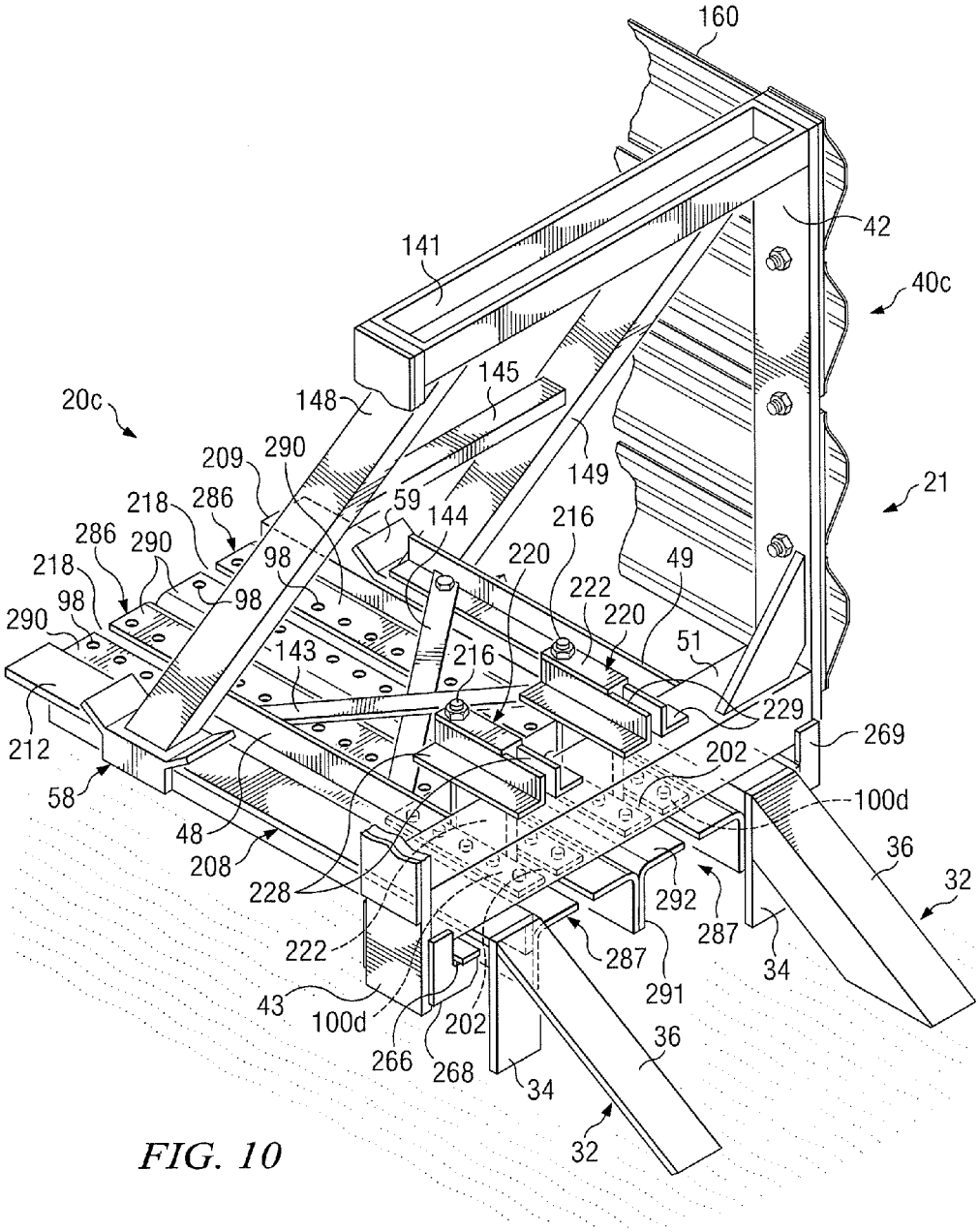
FIG. 10 is a schematic drawing showing an isometric view with portions broken away of an energy absorbing system and associated sled assembly incorporating teachings of the present invention.

A pair of ramps 32 may be provided at end 21 of energy absorbing system 20*b* to prevent small vehicles or vehicles with low ground clearance from directly impacting first ends 187 of rows 188 and 189. Similar ramps 32 are shown in FIG. 10 at first end 21 of energy absorbing system 20*c*. If ramps 32 are not provided, a small vehicle or vehicle with low ground clearance may contact either or both first ends 187 and experience severe deceleration with substantial damage to the vehicle and/or injury to occupants in the vehicle. Various types of ramps and other structures may be provided to ensure that a vehicle impacting end 21 of energy absorbing system 20*b* will properly engage sled assembly 40*b* and not directly contact first ends 187 of rows 188 and 189.

Each ramp 32 may include leg 34 with tapered surface 36 extending therefrom. Connectors (not expressly shown) may be used to securely engage each ramp 32 with respective energy absorbing assembly 86. For some applications, leg 34 may have a height of approximately six and one-half inches. Other components associated with energy absorbing system 20*b* such as energy absorbing assemblies 86 and guide rails 208 and 209 may have a generally corresponding height. Limiting the height of ramps 32 and energy absorbing assemblies 86 will allow such components to pass under a vehicle impacting with end 41 of sled assembly 40.

Tapered surfaces 36 may have a length of approximately thirteen and one-half inches. Tapered surfaces 36 may be formed by cutting a structural steel angle (not expressly shown) having nominal dimensions of three inches by three inches by one-half inch thick into sections with appropriate lengths and angles. The sections of structural steel angle may be attached to respective legs 34 using welding techniques and/or mechanical fasteners. Ramps 32 may also be referred to as "end shoes."

An energy absorbing system formed in accordance with teachings of the present invention may be mounted on or attached to either a concrete or asphalt foundation (not expressly shown). For embodiments such as shown in FIGS. 5 and 8, concrete foundation 308 may extend both longitudinally and laterally from roadside hazard 310. As shown in FIGS. 5 and 6, energy absorbing assemblies 86 are preferably disposed on and securely attached to a plurality of crossties 24. Each crosstie 24 may be secured to concrete foundation 308 using respective anchor bolts 26. Various types of mechanical fasteners and anchors in addition to anchor bolts 26 may be satisfactorily used to secure crossties 24 with concrete foundation 308. The number of crossties and the number of anchors used with each crosstie may be varied as desired for each energy absorbing system.

Crossties 24 may be formed from structural steel strips having a nominal width of three inches and a nominal thickness of one half inch. The length of each crosstie 24 may be approximately twenty-two inches. Three holes may be formed in each crosstie 24 to accommodate anchor bolts 26. During a vehicle collision with either side of energy absorbing system 20, crossties 24 are placed in tension. The materials used to form crossties 24 and their associated configuration are selected to allow crossties 24 to deform in response to tension from such side impacts and to absorb energy from the impacting vehicle.

For some installations, anchor bolts 26 may vary in length from approximately seven inches (7") to approximately eighteen inches (18"). For some applications, holes (not expressly shown) may be formed in an asphalt or concrete foundation to receive respective anchor bolts 26. Various types of adhesive materials may also be placed within the holes to secure anchor bolts 26 in place. Preferably anchor bolts 26 do not extend substantially above the tops of associated nuts 27. Concrete and asphalt anchors and other fasteners satisfactory for use in installing an energy absorbing system incorporating teachings of the present invention are available from Hilti, Inc., at P.O. Box 21148, Tulsa, Okla. 74121.

For purposes of describing embodiments shown in FIGS. 5 and 6, supporting beams 90 immediately adjacent to crossties 24 are designated 90*a*. The respective supporting beams 90 disposed immediately thereabove are designated 90*b*. Supporting beams 90*a* and 90*b* may have substantially identical dimensions and configurations including respective web 92 with flanges or flanges 94 and 96 extending therefrom. Four crossties 24 may be attached to web 92 of supporting beams 90*a* opposite from respective flanges 94 and 96. As a result, the generally C-shaped cross section of each supporting beam 90*a* extends away from respective crossties 24.

The number of crossties 24 attached to each supporting beam 90*a* may be varied depending upon the intended use of the resulting energy absorbing system. For energy absorbing system 20*b*, two supporting beams 90*a* are spaced laterally from each other and attached to four crossties 24. Conventional welding techniques and/or mechanical fasteners (not expressly shown) may be used to attach supporting beams 90*a* with crossties 24.

A pair of guide rails or guide beams 208 and 209 may be attached to respective supporting beams 90*b*. Guide rails 208 and 209 are shown in FIG. 6 and are not shown in FIG. 5. For some applications, guide rails 208 and 209 may be formed from structural steel angles having legs of equal width such as three inches by three inches and a thickness of approximately one-half of an inch. For other applications, a wide variety of guide rails may be used. The present invention is not limited to guide rails or guide beams 208 and 209. For embodiments represented by energy absorbing system 20*c*, guide rails 208 and 209 may have similar configurations and dimensions as associated supporting beams 290.

Guide rails 208 and 209 may each have first leg 211 and second leg 212 which intersect each other at approximately a ninety-degree angle. A plurality of holes (not expressly shown) may be formed along the length of first leg 211 to allow attaching guide rails 208 and 209 with respective supporting beams 90*b*. Mechanical fasteners 103*a* which may be longer than mechanical fasteners 103 may be used to attach guide rails 208 and 209 with supporting beams 90*b*.

The length of guide rails 208 and 209 may be longer than the length of the associated rows 188 and 189 of energy absorbing assemblies 86. When energy absorbing system 20*b* is in its second position panel support frames 60*a*-60*e* are disposed immediately adjacently to each other which prevents further movement of sled assembly 40*b*. Therefore, it is not necessary for rows 188 and 189 of energy absorbing assemblies 86 to have the same length as guide rails 208 and 209.

As shown in FIGS. 5 and 6, corner posts 42 and 43 may be formed from structural steel strips having a width of approximately four inches and a thickness of approximately three quarters of an inch. Each corner post 42 and 43 may have a length of approximately thirty-two inches.

Top brace 141 preferably extends laterally between corner posts 42 and 43. Bottom brace 51 preferably extends laterally between corner post 42 and corner post 43 immediately above guide rails 208 and 209. A pair of braces 148 and 149 may extend diagonally from top brace 141 to a position immediately above guide rails 208 and 209. Only brace 148 is shown in FIG. 5.

A pair of guide assemblies 54 may be respectively attached with the end of each diagonal brace 148 and 149. Only one guide assembly 54 is shown in FIG. 5. The dimensions of each guide assembly 54 may be selected to allow contact associated guide beams or guide rails 208 and 209. For some applications, each guide assembly 54 may be formed with a relative short angle approximately the same dimensions and configurations. Guide assemblies 54 cooperate with each other to insure that sled assembly 40*b* may slide longitudinally along guide rails 208 and 209 in the direction of an associated hazard such as roadside hazard 310. Inertia of sled assembly 40*b* and friction associated with sliding over the top of guide rails 208 and 209 will contribute to deceleration of an impacting vehicle.

Most impacts between a motor vehicle and end 41 of sled assembly 40*b* will generally occur at a location substantially above energy absorbing assemblies 86. As a result, vehicle impact with end 41 will generally result in applying a rotational moment to sled assembly 40*b* which forces guide assemblies 54 to bear down on the top of leg 211 of respective guide rails 208 and 209.

During a collision between a motor vehicle and end 41 of sled assembly 40*b*, force from the vehicle may be transferred from corner posts 42 and 43 to top brace 141 through diagonal braces 148 and 149 to respective guide assemblies 54. As a result, guide assemblies 54 will apply force to guide rails 208 and 209 to maintain desired orientation of sled assembly 40*b* relative to energy absorbing assemblies 86.

As shown in FIGS. 1 and 6 connectors 214 may be attached to bottom brace 51. Connectors 214 may be spaced laterally from each other to receive respective shredders 116. Connectors 224 and 226 are also preferably attached to and extend from respective corner posts 43 and 42. Respective shredders 116 may be attached to connectors 214, 224 and 226.

Support plates 234 and 236 are preferably disposed immediately adjacent to respective shredders 116 opposite from associated energy absorbing assemblies 86. For the embodiment shown in FIGS. 1 and 6 support plate 234 may be attached to respective support post 43 and respective connector 214. Support plate 236 may be attached to respective support post 42 and respective connector 214. Spacer 244 may be installed between bottom brace 51 and horizontal support plate 234 proximate corner post 43. A similar spacer (not expressly shown) may be installed between bottom brace 51 and horizontal support plate 236 proximate corner post 42. Backup plate 238 may be secured to bottom brace 51 opposite from associated shredders 116. Backup plate 238 provides additional support for connectors 214 and horizontal support plates 234, 236.

Sled assembly 40*b* may be slidably disposed on guide rails 208 and 209 and aligned with first end 187 of energy absorbing assemblies 86 with shredders 116 disposed in respective slots 102. The dimensions of shredder 116 and shredding zone 118 between associated supporting beams 90 are selected to allow each shredder 116 to fit between associated flanges 94 and 96 of associated supporting beams 90.

During a collision with end 21 of energy absorbing system 20*b*, a vehicle will often experience a deceleration spike as momentum is transferred from the vehicle to sled assembly 40*b* which results in sled assembly 40*b* and the vehicle moving in unison with each other. The amount of deceleration due to the momentum transfer is a function of the weight of sled assembly 40*b*, along with the weight and initial speed of the vehicle. As sled assembly 40*b* slides longitudinally toward roadside hazard 310, guide assemblies 54 will contact respective guide rails 208 and 208 to maintain desired alignment between sled assembly 40*b*, energy absorbing assemblies 86, shredders 116 and respective shredding zones 118.

When a vehicle impacts the first end 41 of the sled assembly 40*b*, sled assembly 40*b* will move toward hazard 310. Shredders 116, seated in respective slots 102 will engage adjacent energy absorbing elements 100. Shredders 116 will move through adjacent first land or segment 112 shredding the material in land 112. Each shredder 116 will pass through first land 112 and enters the first opening 110. Shredder 116 will then enter the next land 112, shredding the material. The process repeats as shredders 116 pass through lands 112 and openings 110 between respective lands 112. Openings 110 provide reliability in the failure of associated energy absorbing element 100 by both ensuring that shredder 116 remains on a desired path through energy absorbing element 100 and also ruptures energy absorbing element 100 with a predictable amount of force.

The center portion of each energy absorbing element 100 will be shredded between respective supporting beams 90, while the top and bottom portions of each energy absorbing element 100 remains fixed to respective supporting beams 90 by bolts 103. The center portion of each energy absorbing element 100 continues to be shredded as sled assembly 40*b* continues to push respective shredders 116 therethrough. The shredding of portions of energy absorbing elements 100 will stop when kinetic energy from the impacting vehicle has been absorbed. After the passage of shredders 116, one or more energy absorbing elements 100 will be separated into upper and lower parts (not expressly shown).

The length of respective rows 188 and 189 associated with energy absorbing system 20*b* may be selected to be long enough to provide multiple stages for satisfactory deceleration of large, high-speed vehicles after sled assembly 40*b* has moved through a front portion with "relatively soft" energy, absorbing elements. Generally, energy absorbing elements installed in the middle portion of rows 188 and 189 and immediately adjacent to the end of each row will be relatively "hard" as compared to energy absorbing elements installed adjacent to first end 21.

Figure 17:
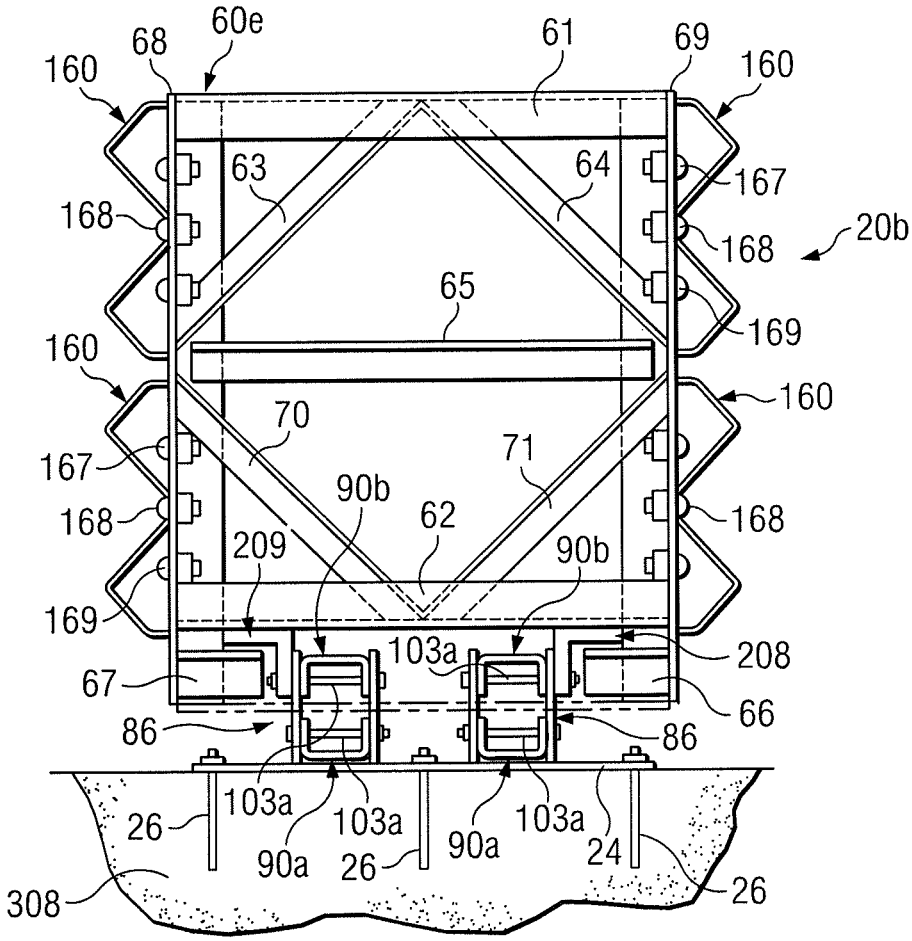
FIG. 17 is a schematic drawing in section with portions broken away showing a panel support frame and attached panels satisfactory for use with an energy absorbing system incorporating teachings of the present invention.

Panel support frames 60*a*-60*e* may have substantially the same dimensions and configuration. Therefore, only panel support frame 60*e* as shown in FIG. 17 will be described in detail. Panel support frame 60*e* has a generally rectangular configuration defined in part by first post 68 disposed adjacent to guide rail 208 and second post 69 disposed adjacent to guide rail 209. Top brace 61 extends laterally between first post 68 and second post 69. Bottom brace 62 extends laterally between first post 68 and second post 69. The length of posts 68 and 69 and the location of bottom brace 62 are selected such that when panel support frame 60*e* is disposed on guide rails 208 and 209, bottom brace 62 will contact guide rails 208 and 209 but posts 68 and 69 will not contact concrete foundation 308.

A plurality of cross braces 63, 64, 65, 70 and 71 may be disposed between posts 68 and 69, top brace 61 and bottom brace 62 to provide a rigid structure. For some applications cross braces 63, 64, 65, 70 and 71 and/or posts 68 and 69 may be formed from relatively heavy structural steel components. Also, cross brace 65 may be installed at a lower position on posts 68 and 69. The weight of support frames 60*a*-60*e* and the location of the associated cross braces may be selected to provide desired strength during a side impact with energy absorbing systems 20, 20*a*, 20*b* or 20*c*.

Tab 66 may be attached to the end of post 69 adjacent to concrete foundation 308 and extends laterally toward energy absorbing assemblies 86. Tab 67 is attached to the end of post 68 adjacent to concrete assembly 308 and extends laterally toward energy absorbing assemblies 86. Tabs 66 and 67 cooperate with bottom brace 62 to maintain panel support frame 60*e* engaged with guide rails 208 and 209 during a side impact with energy absorbing system 20*b* to prevent or minimize rotation in a direction perpendicular to guide rails 208 and 209 while allowing panel support frame 60*e* to slide longitudinally toward roadside hazard 310.

Impact from a vehicle colliding with either side of energy absorbing assembly 20, 20*a*, 20*b*, or 20*c* will be transferred from panels 160 to panel support frames 60*a*-60*g*. The force of the lateral impact will then be transferred from panel support frames 60*a*-60*g* to the associated guide rails 208 and/or 209 to energy absorbing assemblies 86 through cross ties 24 and mechanical fasteners 26 to concrete foundation 308. Cross ties 24, mechanical fasteners 26, energy absorbing assemblies 86, guide rails 208 and 209 along with panel support frames 60*a*-60*g* provides lateral support during a side impact with energy absorbing system.

When a vehicle initially impacts sled assembly 40*b* facing oncoming traffic, any occupants who are not wearing a seat belt or other restraining device may be catapulted forward from their seat. Properly restrained occupants will generally decelerate with the vehicle. During the short time period and distance sled assembly 40*b* travels along guide rails 208 and 209, an unrestrained occupant may be airborne inside the vehicle. Deceleration forces applied to the impacting vehicle during this same time period may be quite large. However, just prior to an unrestrained occupant contacting interior portions of the vehicle, such as the windshield (not expressly shown), deceleration forces applied to the vehicle will generally be reduced to lower levels to minimize possible injury to the unrestrained occupant.

Portions of diagonal braces 148 and 149 and/or top brace 141 of sled assembly 40*b* will contact panel support frame 60*a* which will, in turn, contact panel support frame 60*b* and any other panel support frames disposed downstream from sled assembly 40*b*. Movement of sled assembly 40*b* toward hazard 310 results in telescoping of panel support frames 60*a*-60*e* and their associated panels 160 with respect to each other. The inertia of panel support frames 60 and their associated panels 160 will further decelerate an impacting vehicle as sled assembly 40*b* moves longitudinally from first end 21 toward second end 22 of energy absorbing system 20*b*. The telescoping or sliding of panels 160 against one another produces additional friction forces which also contribute to deceleration of the vehicle. Movement of panel support frames 60*a*-60*e* along guide rails 208 and 209 also produces additional frictional forces to even further decelerate the vehicle.

As previously discussed with respect to FIGS. 4A and 4B, panel support frames 60*a*-60*e* and associated panels 160 will redirect vehicles striking either side of energy absorbing system 20*b* back onto an associated roadway. Each panel 160 may a generally elongated rectangular configuration defined in part by first end or upstream end 161 and second end or downstream end 162. (See FIGS. 5 and 7.) Each panel 160 preferably includes first edge 181 and second edge 182 which extend longitudinally between first end 161 and second end 162. For some applications panels 160 may be formed from standard ten (10) gauge W beam guardrail sections having a length of approximately thirty-four and three-fourth inches for "one-bay panels" and five feet two inches for "two-bay panels." Each panel 160 preferably has approximately the same width of twelve and one-fourth inches.

As shown in FIGS. 5 and 7, respective slot 164 is preferably formed in each panel 160 intermediate ends 161 and 162. Slot 164 is preferably aligned with and extends along the longitudinal center line (not expressly shown) of each panel 160. The length of slot 164 is less than the length of associated panel 160. Respective slot plate 170 may be slidably disposed in each slot 164. The upstream end of each slot 164 preferably includes enlarged portion or key hole portion 164*a* which will be discussed later in more detail.

Metal strap 166 may be welded to first end 161 of each panel 160 along edges 181 and 182 and the middle. See FIG. 8. For some applications metal strap 166 may have a length of approximately twelve and one-fourth inches and a width of approximately two and one-half inches. The length of each metal strap 166 is preferable equal to the width of the respective panel 160 between respective longitudinal edges 181 and 182. Mechanical fasteners 167, 168, and 169 may be used to attach each metal strap 166 with post 68 of associated panel support frame 69. Mechanical fasteners 167 and 169 are substantially identical. Metal straps 166 provide more contact points for mounting end 161 of panels 160 to respective panel support frames 60*a*-60*f*.

Recesses 184 may be formed in each panel 160 at the junction between second end 162 and respective longitudinal edges 181 and 182. (See FIG. 7.) Recesses 184 allow panels 160 to fit with each other in a tight overlapping arrangement when energy absorbing system 20*b* is in its first position. As a result, recesses 184 minimize the possibility of a vehicle snagging the sides of energy absorbing system 20 during a "reverse angle" collision or impact.

For purposes of explanation, panels 160 shown in FIG. 7 have been designated 160*a*, 160*b*, 160*c*, 160*d*, 160*e* and 160*f*. The longitudinal edges of panels 160*a*-160*d* are identified as longitudinal edges 181*a*-181*d* and 182*a*-182*d*, and the longitudinal edges of panel 160*f* are identified as longitudinal edges 181*f* and 182*f*. Also, for panels 160*a*, 160*b*, and 160*d*, ends 161 and 162 are identified as ends 161*a* and 162*a*, ends 161*b* and 162*b*, and ends 161*d* and 162*d*, respectively. Likewise, for panel 160*c*, the upstream end is identified as end 161*c*; and for panel 160*e*, the downstream end is identified as end 162*e*. Respective metal straps 166 may be attached to first end 161*a* and first end 161*d* to post 68 of panel support frame 60*c*. In a similar manner, respective metal straps 166 are provided to securely attach first end 161*b* and 161*e* to corner post 68 of panel support frame 60*d*. As shown in FIGS. 8 and 9, bolt 168 extends through hole 172 in respective slot plate 170 and a corresponding hole (not expressly shown) in panel 160*b*.

As shown in FIG. 9, slot plate 170 preferably includes hole 172 extending therethrough. A pair of fingers 174 and 176 extend laterally from one side of slot plate 170. Fingers 174 and 176 may be sized to be received within associated slot 164 of respective panel 160. Mechanical fastener 168 is preferably longer than mechanical fasteners 167 and 169 to accommodate slot plate 170. Each slot plate 170 and bolt 168 cooperate with each other to securely anchor end 161 of an inner panel 160 with the associate post 68 or 69 while allowing an outer panel 160 to slide longitudinally relative to the associated posts 68 or 69.

During some vehicle impacts panel support frames 60*a*-60*e* and associated panels 160 may move to a second position such as shown in FIG. 4B. As a result repair and reassembly of energy absorbing system 20*b* may be more difficult. However, enlarged portions 164*a* of slots 164 cooperate with associated slot plate 170 to allow the respective panel 160 to be more easily released from the associated panel support frame 60.

For some applications the length of enlarged portion 164*a* may be approximately equal to or greater than the combined length of three slot plates 170. Enlarged portions 164*a* and associated slot plates 170 cooperate with each other to substantially reduce or eliminate many binding and/or interference problems which may result from an impacting vehicle moving an energy absorbing system from a first, extended position to a second, collapsed position. See for example, FIGS. 4A and 4B.

Energy absorbing system 20*c* as shown in FIGS. 10-16 may include sled assembly 40*c* and multiple energy absorbing assemblies 286 aligned in respective rows 288 and 289 extending generally longitudinally from a hazard and generally parallel with each other. For some applications each row 288 and 289 may contain two or more energy absorbing assemblies 286. Energy absorbing assemblies 286 in row 288 may be spaced laterally from energy absorbing assemblies 286 in row 289. See FIGS. 12, 13 and 16.

Sled assembly 40*c* may have a modified configuration similar to sled assembly 40*b*. Energy absorbing assemblies 286 may be secured with each other by a plurality of cross braces 24. Cooperation between cross braces 24 and energy absorbing assemblies 286 results in energy absorbing system 20*c* having a relatively rigid frame structure. As a result, energy absorbing system 20*c* may be better able to absorb impact from a motor vehicle that strikes sled assembly 40*c* offset from the center of end 21 or that strikes end 21 at an angle other than approximately parallel with energy absorbing assemblies 286.

Energy absorbing assemblies 286 may be securely attached to concrete foundation 308 in front of a hazard using cross ties 24 and bolts 26 as described with respect to energy absorbing system 20*b* and energy absorbing assemblies 86. Cross tie attachments 300, which will be discussed later in more detail, may be used to securely engage energy absorbing assemblies 286 with respective cross ties 24. Each row 288 and 289 of energy absorbing assemblies 286 may have a respective first end 287 which corresponds generally with first end 21 of energy absorbing system 20*c*.

Sled assembly 40*c* may be disposed adjacent first end 287 of rows 288 and 289 with shredders 216 aligned with respective energy absorbing assemblies 286 prior to a vehicle impact. For embodiments represented by energy absorbing system 20*c* shredders 216 may be disposed generally vertical relative to sled assembly 40*c*, energy absorbing elements 100 and an associated roadway (not expressly shown). Each shredder 216 may be formed from a bolt having a diameter of approximately one half of an inch and a length of approximately eleven inches. The same materials may be used to form shredders 216 as previously described with respect to shredders 116. Each energy absorbing element 100 may be disposed generally horizontal relative to associated shredders 216 and the roadway. See FIG. 12.

A pair of ramps 32 may be provided at end 21 of energy absorbing system 20*c* to prevent small vehicles or vehicles with low ground clearance from directly impacting first end 287 of rows 288 and 289. Various types of ramps and other structures may be provided to ensure that a vehicle impacting end 21 of energy absorbing system 20*c* will properly engage sled assembly 40*c* and not directly contact first ends 287 of rows 288 and 289.

Each energy absorbing assembly 286 as shown in FIGS. 10-15 may include a pair of supporting beams 290 disposed longitudinally parallel with each other and spaced laterally from each other. Shredding zone 218 may be formed by the resulting longitudinal gap between each pair of supporting beams 290. For some applications supporting beams 290 may have a generally C-shaped cross section as previously described with respect to supporting beams 90 or any other satisfactory cross section.

For applications such as shown in FIGS. 10-14, supporting beams 290 may be described as angles having generally L-shaped cross sections defined in part by first leg 291 and second leg 292. Legs 291 and 292 may intersect each other at an angle of approximately ninety degrees. For some applications supporting beams or angles 290 may be fabricated by using metal roll forming techniques. The use of angles 290 may reduce inventory requirements and cost of both manufacture and repair of an associated crash cushion. For some applications supporting beams 290 and guide rails 208 and 209 may be formed from the same type of structural steel angle.

Figure 12:
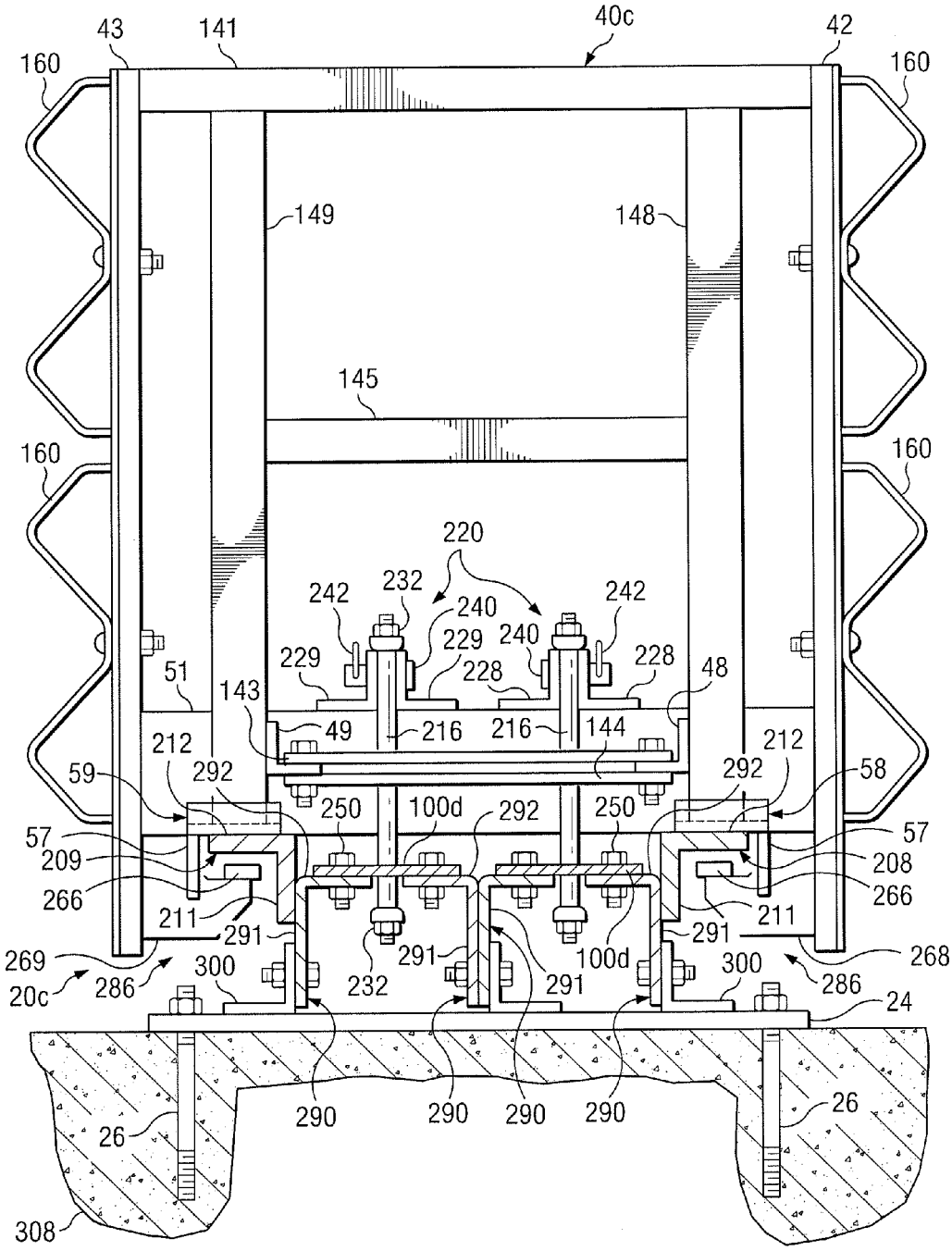
FIG. 12 is a schematic drawing in section and in elevation with portions broken away showing another view of the sled assembly and associated energy absorbing system of FIG. 10.

The L-shaped cross section of each supporting beam 290 may be disposed facing each other to define a generally C-shaped or U-shaped cross section for each energy absorbing assembly 286. For some applications the width of leg 291 may be substantially longer than the width of leg 292. For embodiments such as shown in FIG. 12, the width of each first leg 291 may be approximately equal to the combined width of associated second legs 292 plus the width of shredding zone 218. As a result energy absorbing assembly 286 may have a generally square cross section. See FIG. 12.

Figure 15:
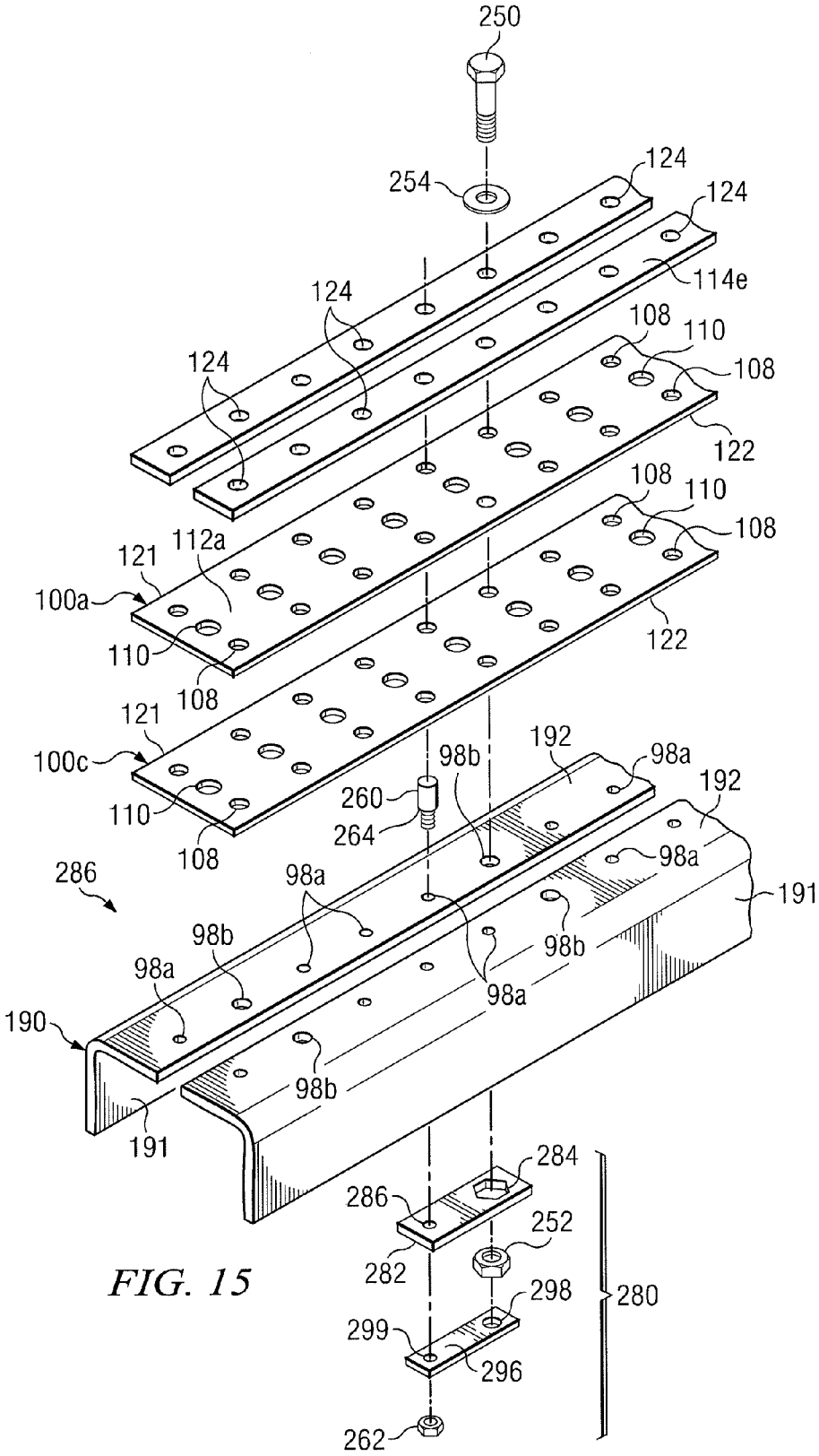
FIG. 15 is a schematic drawing with portions broken away showing an exploded, isometric view of an energy absorbing assembly such shown in FIG. 14 incorporating teachings of the present invention.

A plurality of holes 98 may be formed in each second leg 292 for use in attaching one or more energy absorbing elements 100 with associated energy absorbing assembly 286. For some applications such as shown in FIG. 15, the diameter of holes 98 may vary along the length of each leg 292. For example, some holes 98*b* may have an inside diameter selected to accommodate a typical 9/16" bolt such as mechanical fasteners 250. Other holes 98*a* may have a smaller inside diameter selected to accommodate a 3/8" bolt or threaded stud with a 9/16" diameter shoulder and no head such as mechanical fasteners 260.

For purposes of describing various features of the present invention energy absorbing elements 100 associated with energy absorbing assemblies 286 may be designated as energy absorbing elements 100*a*, 100*b*, 100*c* and 100*d*. For some applications energy absorbing assemblies 286 may have approximately the same overall length, width and height as previously described for energy absorbing assemblies 86. Various types of fasteners may be inserted through holes 98 in supporting beams 290 and corresponding holes 108 formed in energy absorbing elements 100.

A pair of energy absorbing elements 100*d* may be disposed on each energy absorbing assembly 286 proximate first end 21 of energy absorbing assembly 20*c*. See FIGS. 11, 12 and 16. Energy absorbing elements 100*d* are shown in dotted lines in FIG. 10. The overall length of energy absorbing elements 100*d* may be substantially reduced as compared to energy absorbing elements 100*a*, 100*b* and 100*c*. Slot 202 may be formed in each energy absorbing element 100*d* to receive respective shredder 216.

Dimensions associated with each shredder 216 are preferably selected to be compatible with associated slot 202 and gap or shredding zone 218 formed between associated supporting beams 290. The dimensions may be selected to allow each shredder 216 to slide longitudinally between second legs 292 of associated supporting beams 290. For embodiments such as shown in FIGS. 10-16, energy absorbing elements 100*d* have a relatively short length. However, the length of energy absorbing elements 100*d* may be increased based on the amount of energy absorption desired within the first stage of an associated energy absorbing system.

A plurality of holes (not expressly shown) may be formed along the length of each first leg 291 to allow attaching guide rails 208 or 209 with associated supporting beams 290. See for example FIGS. 10-13. Various welding techniques and/or other mechanical attachment techniques may also be satisfactorily used to securely engage guide rails 208 and 209 with respective energy absorbing assemblies 286. Guide rails 208 and 209 cooperate with each other to allow sled assembly 40*c* to move longitudinally from first end 21 of energy absorbing assembly 20*c* toward an associated hazard. First leg 211 of guide rails 208 and 209 may be attached to first leg 291 of associated supporting beams 270.

Figure 11:
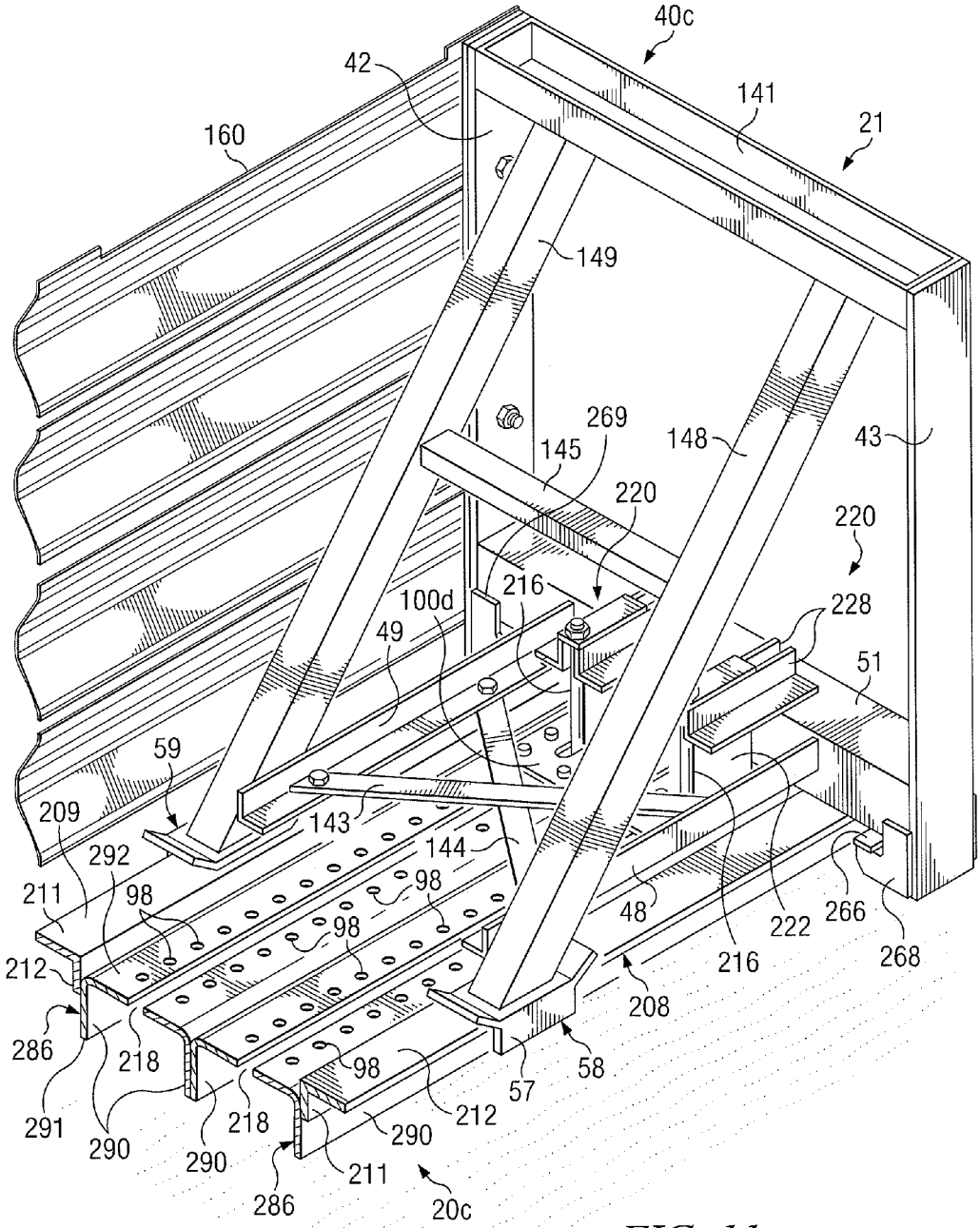
FIG. 11 is a schematic drawing showing another isometric view with portions broken away of the energy absorbing system and sled assembly of FIG. 10.

For some applications shredders 216 may be installed as part of replaceable modules 220. As shown in FIGS. 10, 11 and 12 each module 220 may include respective support plate 222 disposed between shredder 216 and bottom brace 51. Support plates 222 are shown in dotted lines in FIGS. 10 and 13. Respective pairs of angles or brackets 228 and 229 may be attached with bottom brace 51 extending in the direction of associated rows 288 and 289. Each pair of angles 228 and 229 may be spaced from each other to slidably receive respective module 220 therein. For some applications the upper portion of each module 220 may be enlarged with respective shoulders (see FIG. 10). As a result modules 220 may be inserted between respective pairs of angles 228 or 229 with the shoulders resting on the respective pair of angles 228 or 229.

For some applications support plates 222 may be modified to have a blunt shredding surface formed on the respective downstream edge facing respective energy absorbing assemblies 286. For such embodiments the blunt shredding surface may be formed as an integral component (not expressly shown) of support plates 222. Support plate 222 may be formed from substantially the same materials as used to form shredders 216.

For some applications respective retainer lugs 240 may extend through openings (not expressly shown) in each module 220 and associated brackets 228 or 229. See FIG. 12. Cotter pin 242 or similar devices may be used to releasably engage retainer lug 240 with associated module 220 and brackets 228 or 229. In the event of failure or damage to shredder 216, associated cotter pin 242 may be removed to allow retainer lug 240 to be disengaged from associated module 220 and respective brackets 228 or 229. Module 220 may then be removed and damaged shredder 216 replaced.

For some applications each shredder 216 may have threads formed on opposite ends thereof to receive respective nuts 232. See FIG. 12. Support plates 220 may have appropriately sized openings to receive respective shredder 216 therethrough. Nuts 232 may be attached with the threaded portions of each shredder 216 to securely engage shredders 216 with associated support plates 222. Various other mechanisms and techniques may be satisfactorily used to releasably engage shredders 216 with sled assembly 40*c*. The present invention is not limited to modules 220, vertical support plates 222, retainer lugs 240 or nuts 232.

Sled assembly 40*c* may be include corner posts 42 and 43 along with other features of previously described sled assembly 40*b*. Top brace 141 and bottom brace 51 preferably extend laterally between corner posts 42 and 43. Bottom brace 51 may be disposed immediately adjacent to second leg 212 of guide rails 208 and 209. See FIG. 12. The dimensions and materials used to form bottom brace 51 may be selected to provide substantial strength for transferring of energy from an impacting vehicle to shredders 216 and associated energy absorbing elements 100. The height of bottom brace 51 and the length of legs 42 and 43 may be selected to provide substantial clearance between the bottom of corner post 42 and 43 with respect to concrete foundation 308 and cross ties 24. See FIG. 12. The dimensions of bottom brace 51 and the length of corner post 42 and 43 cooperate with each other to reduce the possibility that any portion of sled assembly 40*c* may contact cross ties 24 and/or portions of anchor bolts 26. As a result, sled assembly 40*c* may often be reused after a vehicle impact.

For some applications such as shown in FIGS. 10, 11 and 12, a pair of hook shaped plates 268 and 269 may be attached proximate the end corners 43 and 42. Respective contact plates 266 may be attached to each pair of hook plates 268 and 269. Hook shaped plates 268 and associated contact plates 266 may engage adjacent portions of guide rail 208 to resist side impacts with sled assembly 40*b* and maintain sled assembly 40*b* slidably disposed on guide rails 208 and 209.

Hook shaped plates 269 and associated contact plate 266 may engage adjacent portions of guide rail 209 for similar purposes and functions.

Gussets may be disposed between corner posts 42 and 43 and bottom brace 51 to provide additional structural support. One or more reinforcing braces or angles (not expressly shown) may be disposed on bottom brace 51 and adjacent to portions of modules 220.

A pair of braces 148 and 149 may extend diagonally from top brace 141 to a position immediately above guide rails 208 and 209. Braces 48 and 49 may extend longitudinally from bottom brace 51 and engage diagonal braces 148 and 149 proximate respective guide rails 208 and 209. For some applications horizontal braces 48 and 49 may be formed from angles. Cross braces 143 and 144 may be securely engaged with horizontal braces 48 and 49 in a generally X-shaped pattern. Horizontal brace 145 may be disposed between diagonal braces 148 and 149.

Guide assemblies 58 and 59 may be attached with respective ends of diagonal braces 148 and 149. Guide assemblies 58 and 59 and guides 54 may have similar features and characteristics. Guide assemblies 58 and 59 may be formed from an angle having dimensions compatible with associated guide rails 208 and 209. Guide assemblies 58 and 59 cooperate with each other to allow sled assembly 40*c* to slide longitudinally along guide rails 208 and 209 in the direction of an associated hazard.

Guide assemblies 58 and 59 may include respective first legs 57 which extend downwardly relative to associated guide rail 208 and 209. Legs 57 cooperate with each other to maintain sled assembly 40*c* disposed on guide rails 208 and 209 and shredders 216 aligned with respective shredding zones 218 during a vehicle impact while at the same time allowing sled assembly 40*c* to slide longitudinally along guide rails 208 and 209 towards an associated hazard. Legs 57 cooperate with each other to limit undesired lateral movement of sled assembly 40*c* in response to a side impact. The inertia of sled assembly 40*c* and friction associated with guide assemblies 58 and 59 and bottom brace 51 sliding over legs 212 of guide rails 208 and 209 will contribute to deceleration of an impacting vehicle.

A plurality of mechanical fasteners may be used to securely engage energy absorbing elements 100 with associated supporting beams 290 to form energy absorbing assemblies 286. By installing energy absorbing assemblies 286 with associated energy absorbing elements 100 in a generally horizontal orientation relative to other components of energy absorbing system 20*c* and an associated roadway, the mechanical fasteners may be more readably accessible for replacing damaged components and installing new components. See FIG. 13.

Figure 14:
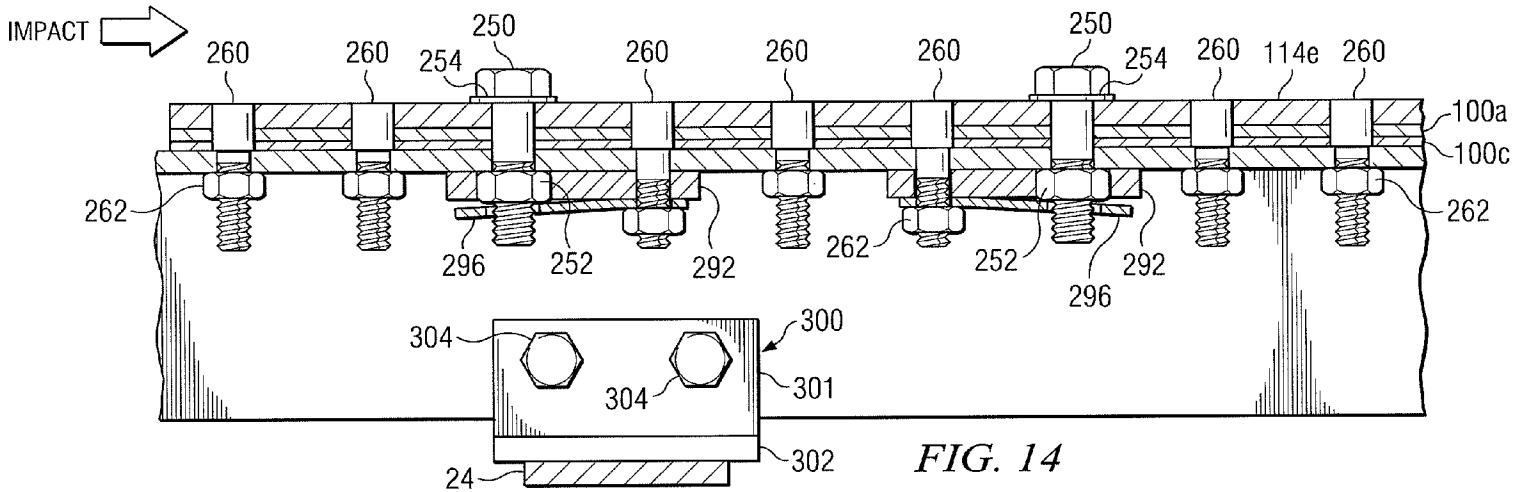
FIG. 14 is an enlarged, schematic drawing in section and in elevation with portions broken away taken along lines 14-14 of FIG. 13.

For example, bolts 250 and associated nuts 252 may be used to securely engage one or more energy absorbing elements 100 with respective supporting beams 290. A plurality of headless bolts 260 may also be used to releasably secure energy absorbing elements 100 with associated supporting beams 290. Dimensions associated with headless bolts 260 and corresponding openings 108 in associated energy absorbing elements 100 may be selected such that energy absorbing elements 100 may be installed and removed after disengagement of the mechanical fasteners 250 and without disengagement of headless bolts 260. For embodiments such as shown in FIGS. 14 and 15, bolts 250 and washers 254 may be removed to allow disengagement of doublers 114 and associated energy absorbing elements 100*a* and 100*c*. Nut 252 will preferably remain securely engaged with associated nut retainer 280.

For some embodiments of the present invention such as represented by energy absorbing system 20*c*, each energy absorbing element 100 may have a generally elongated rectangular configuration defined in part by first longitudinal edge 121 and second longitudinal edge 122. See FIGS. 15 and 16. A first row of openings 108 may be formed in each energy absorbing element 100 adjacent to first longitudinal edge 121. A second row of openings 108 may be formed in each energy absorbing element 100 adjacent to respective second longitudinal edge 122. A third row of openings 110 with lands 112 disposed therebetween may be formed in each energy absorbing element 100 between the first row of openings 108 and the second row of openings 108. See FIGS. 15 and 16.

For some applications energy absorbing system 20*c* may have a relatively soft first stage, a second stage having increased energy absorbing capability and a third stage designed to absorb the energy of a high speed and/or heavy vehicle. The length of energy absorbing elements 100*d* in the first stage may be increased and/or decreased to vary the amount of energy absorbed during initial impact of a vehicle with sled assembly 40*c*.

The second stage of energy absorbing system 20*c* may include energy absorbing elements 100*a* with variable spacing between associated openings 110 and associated lands 112. For embodiments such as shown in FIG. 16 the first portion of each energy absorbing element 100*a* may include openings 110 having a diameter of approximately one inch with a spacing of approximately two inches between the centers of adjacent openings 110. The middle portion of each energy absorbing element 100*a* may include openings 110 having a diameter of approximately one inch and a spacing of approximately two inches between centers of adjacent openings 110. As a result, the length of segments 112*a* in the first portion of each energy absorbing element 100*a* may be approximately one inch. Each segment 112*b* in the middle portion of energy absorbing element 100*a* may have a length of approximately two inches.

When a vehicle initially impacts sled assembly 40*c* a portion of the vehicle's energy will be absorbed in the first stage. When shredders 216 engage energy absorbing elements 100*a*, the amount of energy absorbed by segments 112*a* may increase as compared with the first stage (energy absorbing elements 100*d*) but may remain at a lower value as compared with energy absorbed by segments 112*b*. The increased length of segments or lands 112*b* results in increased deceleration as compared with the shorter segments 112*a*. Therefore, substantial amounts of energy may be absorbed as shredders 216 move through the middle portion of respective energy absorbing elements 100*a*.

As an impacting vehicle starts to slow down, less energy absorption may be desired to prevent an unrestrained occupant from impacting portions of the vehicle. Therefore, the spacing between holes 110 in the third portion or last portion of each energy absorbing element 100*a* may be reduced. For example, segments 112*c* may have approximately the same length as segments 112*a* or the length of segments 112*c* may be even more reduced as compared with the length of segments 112*a*.

For many vehicle impacts, most of the energy absorption may occur in stages one and two. However, for very high speed and/or heavy vehicles, shredders 216 may engage energy absorbing elements 100*b* in stage three. For some applications the thickness of energy absorbing elements 100*b* in stage 3 may be substantially increased. Alternatively, the spacing between holes 110 in stage 3 may be substantially increased. Teachings of the present invention allow modifying energy absorbing elements 100 to provide desired deceleration for a wide variety of vehicles traveling at a wide variety of speeds without resulting in injury to an unrestrained occupant of the vehicle.

For some applications two or more energy absorbing elements 100 may be disposed on second leg 292 of each supporting beam 290. For embodiments such as shown in FIG. 14, the thickness of energy absorbing elements 100*a* and 100*c* may vary. Also, the spacing between respective openings 110 and/or the size of openings 110 formed in each energy absorbing element 100*a* and 100*c* may be varied.

Figure 13:
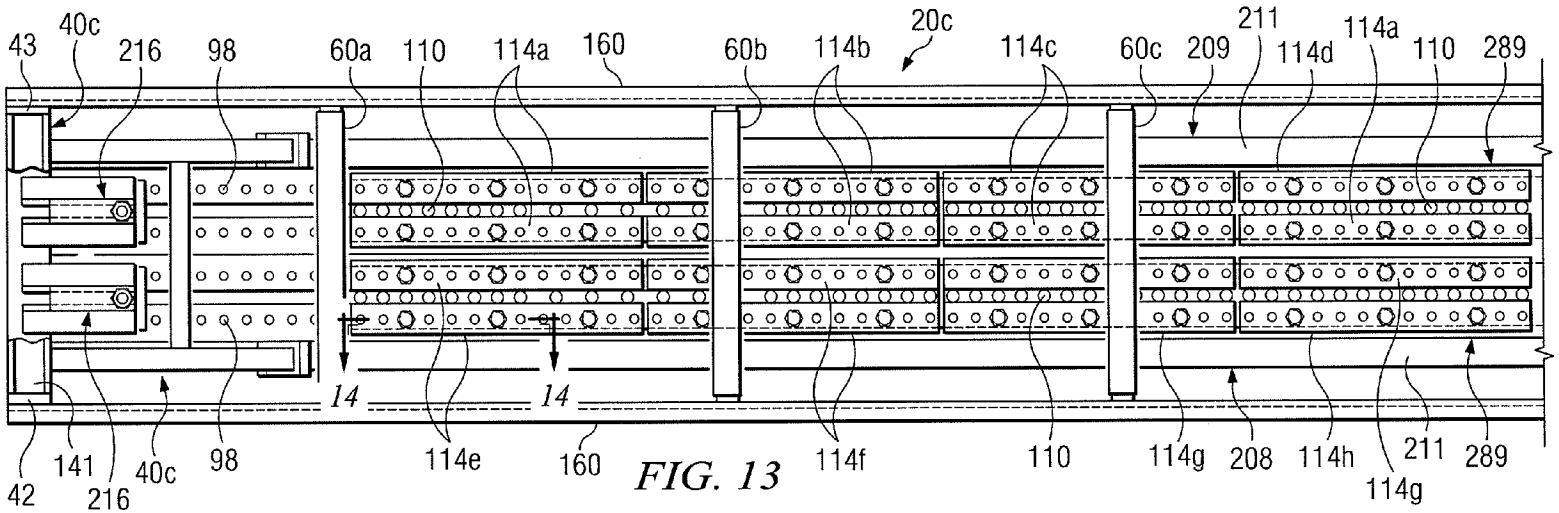
FIG. 13 is a schematic drawing showing a plan view with portions broken away of the sled assembly, shredders and associated energy absorbing assemblies and associated energy absorbing system of FIG. 10.

As previously noted the present invention allows reducing the number of mechanical fasteners which must be engaged and disengaged during replacement of a ruptured or shredded energy absorbing element 100. As shown in FIGS. 14 and 15 one or more headless mechanical fastener or headless bolts 260 may be disposed between respective mechanical fasteners 250. For some applications doublers or strong backs 114 may be disposed on energy absorbing elements 100 opposite from second leg 292 of associated support beam 290. Doublers or strong backs 114 improve the holding force of associated mechanical fasteners 250 while at the same time accommodating the use of headless bolts 260. For some applications such as shown in FIG. 13, pairs of doublers, designated 114*a*-114*h*, may be used to securely engage respective energy absorbing elements 100 with associated energy absorbing assemblies 286. Each doubler 114 preferably includes holes 124 corresponding in diameter with associated holes 108 formed along the longitudinal edges 121 and 122 of each energy absorbing element 100. Holes 124 formed in doublers 114 are preferably selected to accommodate both bolts 250 and headless bolts 260.

Various techniques and procedures may be satisfactorily used to manufacture and assemble energy absorbing assemblies in accordance with teachings of the present invention. For example, energy absorbing assemblies 286 such as shown in FIGS. 13, 14, 15 and 16 may be manufactured and assembled by forming supporting beams 290 having a plurality of holes 98*a* and 98*b* extending through each leg second 292. For embodiments such as shown in FIGS. 13, 14, 15 and 16 three small holes 98*a* may be disposed between adjacent larger diameter holes 98*b*. Energy absorbing elements 100 and doublers 114 which may be releasably attached with each second leg 292.

Headless bolts 260 may be inserted through respective small diameter holes 98*a*. Shoulder 264 on each headless bolt 260 will preferably engage adjacent portions of second leg 292. Respective nuts 262 may be engaged with the threaded portion of each headless bolt 260 extending through second leg 292. One or more energy absorbing elements 100 may be placed or stacked on respective second legs 292 by inserting headless bolts 260 through associated holes 108. Doublers 114 will also be placed on respective energy absorbing elements 100 by inserting headless bolts 260 through associated holes 124. Respective mechanical fasteners 250 may then be inserted through associated openings 124 in doublers 114, openings 108 in energy absorbing elements 100 and large diameter opening 98*b* in associated second leg 292. Washer 254 may be disposed between the head of bolt 250 and doubler 114. Nut 252 may then be securely engaged with each bolt 250 to securely attach energy absorbing elements 100*a* and 100*c* with respective supporting beams 290. Doublers 114 effectively increase the "holding power" of associated bolts 250 and nuts 252.

For some applications such as shown in FIGS. 14 and 15 respective nut retainers 280 may be disposed on each second leg 292 opposite from energy absorbing elements 100. Each nut retainer 280 preferably includes at least one opening with respective nut 252 disposed therein. Nut retainer 280 allows associated mechanical fastener 250 to be engaged and disengaged without having to hold nut 252. Therefore, when energy absorbing assembly 286 is disposed with energy absorbing elements 100 in a generally horizontal position, engagement with only the head of mechanical fastener 250 is required to engage and disengage mechanical fastener 250 from respective nut 252.

Nut retainers 280 may be formed with various configurations and orientations. For some applications nut retainer 280 may include one or more welded attachments (not expressly shown) to secure each nut 252 aligned with respective opening 98*b*. For other applications each nut retainer 280 may include a generally rectangular plate 282 with a first opening 284 and second opening 286 formed therein. First opening 284 may be selected to receive associated nut 252. Second opening 286 is preferably smaller than first opening 284. Second opening 286 may be sized to receive the threaded portion of associated headless bolt 260. Keeper plate 296 may be attached to nut retainer 280 opposite from second leg 292 of supporting beam 290. Keeper plate 296 may also include first hole 298 sized to receive the threaded portion of associated mechanical fastener 250 and second hole 299 sized to receive the threaded portion of headless bolt 260. For some applications retainer plate 282 and keeper plate 296 may be installed on associated headless bolt 260 prior to engaging nut 262 with the respective threaded portion. Hole 298 of each keeper plate 296 with nut 252 disposed therein is preferably aligned with associated large diameter hole 98*b* in second leg 192 of associated supporting beam 290. Hole 299 in each keeper plate 296 is preferably aligned with associated smaller diameter hole 98*a* in second leg 192 of associated supporting beam 290.

For some applications energy absorbing elements 100*d* may be attached to associated supporting beams 290 by four mechanical fasteners bolts 250 and no doublers. Energy absorbing element 100*a* may be attached to associated supporting beams 290 by eight doublers and twenty four mechanical fasteners 250. Energy absorbing elements 100*b* may also be attached to associated supporting beams 290 by eight doublers and twenty four mechanical fasteners 250. For some applications the length of energy absorbing system 20*c* may be increased by adding more energy absorbing assemblies 286.

Various types of mechanisms may be satisfactorily used to engage energy absorbing assemblies 286 with cross ties 24. For embodiments such as shown in FIG. 14, each cross tie attachment 300 may have the general configuration of an angle defined in part by legs 301 and 302. A plurality of mechanical fasteners 304 may be disposed between openings formed in leg 301 and securely engaged with corresponding holes (not expressly shown) formed in first leg 291 of associated supporting beam 290. Second leg 302 of each cross tie attachment 300 may be welded or otherwise securely attached with associated cross tie 24.

Technical benefits of the present invention may include providing modular base units which may be preassembled prior to delivery at a roadside location. For some applications each modular base unit may include rows 188 and 189 or rows 288 and 289, sled assembly 40*b* or 40*c* and panel support frames 60*a*-60*g* with panels 160 installed in their first position. The use of a modular base unit may minimize repair time at a roadway location and allow for more efficient, cost effective repair of a damaged modular base unit at an off site repair facility.

Energy absorbing assemblies 86 or 286 and shredders 116 and 216 may also be used in a wide variety of movable applications such as truck mounted attenuators. The present invention is not limited to relatively fixed applications such as represented by energy absorbing system 20, 20*a*, 20*b* and 20*c*. For truck mounted attenuators, such as described in U.S. Pat. No. 5,947,452, energy absorbing assemblies 86 or 286 may be attached to and extend rearwardly from a truck or other vehicle (not expressly shown). An impact head (not expressly shown) may be provided at the end of energy absorbing assemblies 86 or 286 opposite from the truck or other vehicle. Respective shredders 116 or 216 may be mounted on the truck or other vehicle opposite from the impact head. Each shredder 116 or 216 may be aligned with respective energy absorbing assembly 86 or 286 as previously shown. When a second vehicle contacts the impact head, the shredders will remain fixed relative to the energy absorbing assemblies as the energy absorbing assemblies move past the respective shredders. The shredders operate as discussed above and energy is dissipated so that the second vehicle is slowed and then stopped.

Although the present invention has been described in detail, it should be understood that various changes, substitutions and alterations can be made hereto without departing from the spirit and scope of the invention as defined by the appended claims.

What is claimed is:

1. An energy absorbing system comprising:

at least one energy absorbing assembly having a pair of supporting beams with at least one energy absorbing element coupled to the supporting beams;

the energy absorbing system disposed with the energy absorbing element extending generally horizontally relative to a roadway;

a plurality of openings formed in each supporting beam and corresponding openings formed in each energy absorbing element;

a plurality of mechanical fasteners respectively extending through the openings in energy absorbing element and the corresponding openings in the supporting beams;

a doubler disposed on each energy absorbing element opposite from the respective support beam; and each doubler including a respective row of openings formed therein, each row being aligned with the plurality of openings formed in a particular one of the support beams, and wherein each respective row of openings includes an associated one of the mechanical fasteners extending through one of the openings in the respective row.

2. An energy absorbing system, comprising:

at least one energy absorbing assembly having a pair of supporting beams with at least one energy absorbing element coupled to the supporting beams;

the energy absorbing system disposed with the energy absorbing element extending generally horizontally relative to the roadway;

a plurality of openings formed in each supporting beam and corresponding openings formed in each energy absorbing element;

a plurality of mechanical fasteners respectively disposed within the openings in each energy absorbing element and the corresponding openings in the supporting beams;

each energy absorbing element having a generally elongated rectangular configuration defined in part by a first longitudinal edge and a second longitudinal edge;

a first row of openings and a second row of openings formed along each respective first longitudinal edge and second longitudinal edge of each energy absorbing element; and a third row of openings with lands disposed therebetween extending along the length of each energy absorbing element between the first row of openings and the second row of openings.

3. The energy absorbing system of claim 2 wherein the mechanical fasteners further comprise:

a plurality of headless bolts securely engaged with respective openings in the supporting beams; and dimensions of the headless bolts and respective openings formed in the first row of openings and the second row of openings in each energy absorbing element selected to allow installing and removing each energy absorbing element without disengagement of the headless bolts from the associated supporting beams.

4. The energy absorbing system of claim 3 further comprising:

a plurality of bolts with heads engaged with respective openings in the first row and the second row of each energy absorbing element and respective openings in the supporting beams; and at least one of the headless bolts disposed between the bolts with heads.

5. The energy absorbing system of claim 1 further comprising:

at least one nut retainer securely engaged with each supporting beam opposite from the associated energy absorbing element;

a nut disposed within each nut retainer; and the nut operable to receive a bolt extending through one of the openings in the associated energy absorbing element to the securely engaged the energy absorbing element with the supporting beam.

6. The energy absorbing system of claim 5 wherein the nut retainer further comprises:

a plate having a generally rectangular configuration with dimensions compatible with attachment to the associated supporting beam;

a first opening disposed in the retainer plate and a second opening disposed in the retainer plate;

the first opening sized to receive a first mechanical fastener extending through the associated energy absorbing element and the supporting beams; and the second opening sized to receive a second mechanical fastener extending through the associated energy absorbing element and the supporting beam.

7. The energy absorbing system of claim 6 further comprising:

a keeper plate attached with the nut retainer plate opposite from the supporting beams;

a first end of the keeper plate securely engaged with the first mechanical fastener; and a second end of the keeper plate disposed proximate the nut to releasably hold the nut in the retainer plate.

8. The energy absorbing system of claim 1, comprising:

a plurality of bolts with heads engaged with respective openings in the energy absorbing element and the respective openings in the supporting beams; and a plurality of headless bolts securely engaged with respective openings in the supporting beams.

9. The energy absorbing system of claim 1, wherein dimensions of the headless bolts and respective openings formed in the openings in each energy absorbing element selected to allow installing and removing each energy absorbing element without disengagement of the headless bolts from the associated supporting beams.

10. The energy absorbing system of claim 2, further comprising:

at least one nut retainer securely engaged with each supporting beam opposite from the associated energy absorbing element;

a nut disposed within each nut retainer; and the nut operable to receive a bolt extending through one of the openings in the associated energy absorbing element to the securely engaged the energy absorbing element with the supporting beam.

11. The energy absorbing system of claim 10, wherein the nut retainer further comprises:

a plate having a generally rectangular configuration with dimensions compatible with attachment to the associated supporting beam;

a first opening disposed in the retainer plate and a second opening disposed in the retainer plate;

the first opening sized to receive a first mechanical fastener extending through the associated energy absorbing element and the supporting beams; and the second opening sized to receive a second mechanical fastener extending through the associated energy absorbing element and the supporting beam.

12. The energy absorbing system of claim 11, further comprising:

a keeper plate attached with the nut retainer plate opposite from the supporting beams;

a first end of the keeper plate securely engaged with the first mechanical fastener; and a second end of the keeper plate disposed proximate the nut to releasably hold the nut in the retainer plate.

* * * * *